US008241062B2

(12) United States Patent
Tsuruta

(10) Patent No.: US 8,241,062 B2
(45) Date of Patent: Aug. 14, 2012

(54) SHIELDING CONNECTOR AND WIRE HARNESS

(75) Inventor: Satoshi Tsuruta, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 115 days.

(21) Appl. No.: 12/858,495

(22) Filed: Aug. 18, 2010

(65) Prior Publication Data

US 2011/0045701 A1 Feb. 24, 2011

(30) Foreign Application Priority Data

Aug. 21, 2009 (JP) ..... 2009-192283

(51) Int. Cl.
*H01R 13/40* (2006.01)

(52) U.S. Cl. ..... 439/589; 439/587; 439/352; 439/903

(58) Field of Classification Search ..... 439/587–589, 439/274, 275, 352, 903
See application file for complete search history.

(56) References Cited

U.S. PATENT DOCUMENTS

| | | | | |
|---|---|---|---|---|
| 4,810,208 | A * | 3/1989 | Hayes et al. | 439/589 |
| 5,934,938 | A * | 8/1999 | Clark et al. | 439/587 |
| 6,250,962 | B1 * | 6/2001 | Shinozaki | 439/587 |
| 7,083,471 | B2 | 8/2006 | Hayashi | |
| 7,578,694 | B2 * | 8/2009 | Takahashi et al. | 439/352 |

* cited by examiner

*Primary Examiner* — Hien Vu
(74) *Attorney, Agent, or Firm* — Gerald E. Hespos; Michael J. Porco

(57) ABSTRACT

A shielding connector has a housing (20) accommodating female terminals (15) connected to electric wires (10). The housing (20) is inserted in a die cast tubular shielding shell (40). An elastic locking piece (34) is provided on the housing (20) and locks an open edge (48) of the shielding shell (40) to prevent removal of the housing (20) that has been mounted properly in the housing (20). A retainer (50) is mounted on the housing (20) from the rear and prevents the elastic locking piece (34) from flexibly displacing in an unlocking direction. An open end (70A) of a braided wire (70) is placed on a mounting groove (46) formed on the shielding shell (40) and is fixed to the mounting groove (46) with a tightening band (60) whose diameter can be decreased with a tool.

11 Claims, 25 Drawing Sheets

SHIELDING CONNECTOR AND WIRE HARNESS

BACKGROUND OF THE INVENTION

1. Field of the Invention

The invention relates to a shielding connector and a wire harness using the shielding connector.

2. Description of the Related Art

U.S. Pat. No. 7,083,471 discloses an example of an electric wire-side shielding connector. The electric wire-side shielding connector has a female housing and a plurality of female terminals accommodated in the female housing. The female terminal fittings are connected to electric wires. A die cast tubular shielding shell is fit on the female housing from the rear end so that the shielding shell covers the female housing. An elastic locking piece is provided on the female housing elastically locks a locking part on the shielding shell. Thus, the female housing is accommodated in and locked to the shielding shell. Open ends of the bundled braided wires are caulked and crimped to the periphery of the shell.

The electric wire-side shielding connector is fit on an equipment-side shielding connector that has a male housing with male terminals accommodated therein. The connection may be carried out with assistance of a boost mechanism, such as a wrench. The male housing is covered with a shielding shell and the shielding shells are connected to each other when the housings are connected.

The shielding connectors can be unlocked from each other so that the electric wire-side shielding connector can be pulled out of the mating equipment-side shielding connector. The terminals in this type of the shielding connector are large and are fit on each other with a large contact pressure. The housings also are connected to each other with a large frictional force. The forces that are needed to separate the two connectors also urge the shielding shell rearward relative to the female housing. The engagement of the elastic locking piece and the locking part is intended to prevent the shielding shell from separating from the female housing. However, there is a fear that the excessively large force required to separate the connected terminals and the connected housings could displace the elastic locking piece sufficiently to separate the shielding shell from the female housing. The elastic locking piece could lock the locking part over a large area to prevent separation of the shielding shell from the female housing. However, a large locking area requires a large space to accommodate the displacement of the elastic locking piece in an unlocking direction. Thus, the housing and the connector become undesirably large.

The invention has been completed in view of the above-described situation. It is an object of the invention to fix a housing to a shielding shell at a higher force without making the housing large.

SUMMARY OF THE INVENTION

The invention relates to a shielding connector with a housing that accommodates female terminals connected to electric wires. The housing is inserted into a die cast tubular shielding shell. A flexible locking piece on the housing can lock an open edge of the shielding shell to prevent removal of the properly mounted housing. A retainer is mounted on a rear of the housing and prevents the elastic locking piece from flexibly displacing in an unlocking direction. Therefore, the force that fixes the shielding shell to the housing is increased greatly and the shielding shell is not likely to be separated.

The terminal fittings are inserted into terminal accommodation parts in the housing. An entrance of each of the terminal accommodation parts is closed with a rubber stopper and a rubber stopper holder is provided on a rear surface of the housing for preventing removal of the rubber stopper. The retainer is provided for the rubber stopper. This simple construction holds the housing inside the shielding shell at a high force.

The shielding connector includes a braided wire surrounding a periphery of the electric wires and a braided wire-fixing part formed on the shielding shell. An open end of the braided wire is mounted to cover the braided wire-fixing part in a state in which the housing is inserted normally into the shielding shell and the retainer is mounted on the housing. A tightening band is mounted over the portion of the braided wire that is mounted on the braided wire-fixing part. A tool is used to decrease the diameter of the tightening band and to caulk the open end of the braided wire on the braided wire-fixing part.

The braided wire-fixing part conceivably could be set on the peripheral surface of a penetration region of the elastic locking piece on the housing. A caulking ring that has a mold or a die then would be used for caulking the open portion of the braided wire and it would be necessary to insert a core into the shielding shell as an underlay. The housing would be inserted into the shielding shell after the open end of the braided wire is caulked and would be locked by the elastic locking piece. However, this hypothetical design would not prevent the elastic locking piece from flexing in an unlocking direction. As a result, this hypothetical design would not achieve double locking of the elastic locking piece and there is a fear that the housing is insufficiently locked to the shielding shell.

On the other hand, the invention employs the tightening band for caulking the open end of the braided wire. The tightening band eliminates the need for a core and can be caulked with a tool merely by performing only an external operation. The procedure of assembling the electric wire-side shielding connector includes inserting the housing into the shielding shell and primarily locking the housing by the elastic locking piece, mounting the retainer on the housing to doubly lock the housing, covering the mounting groove of the shielding shell with the open end of the braided wire, fitting the tightening band in the mounting groove and operating a tool from an external location to caulk the open end of the braided wire for doubly locking the housing.

The wire harness includes a shielding connector at an end of an electric wire; and a shielding pipe mounted on a periphery of an intermediate portion of the electric wire. One open end of the braided wire is fixed to the shielding shell of the shielding connector by caulking the open end with a tightening band. The other open end of the braided wire is caulked to the shielding pipe with a tightening band whose thickness is equal to the thickness of the tightening band caulked to the shielding shell. Thus, a predetermined length of the wire harness adjacent to the electric wire-side shielding connector is surrounded by the braided wire and an intermediate portion of the electric wire is surrounded with the shielding pipe. One open end of the braided wire is caulked to the shielding shell with the tightening band whose diameter can be decreased with a tool, whereas the other open end of the braided wire is caulked to the shielding pipe with a tightening band whose thickness is equal to that of the tightening band caulked to the shielding shell. The above-described caulking operations eliminate the need for a large-scale die device and can be performed by operating the tool. It is possible to perform the operation of decreasing the diameter of the tightening bands of this kind with the same tool when the tightening bands have equal thicknesses, even though the diameters thereof are different from each other. Therefore, the operation of caulking the braided wire and the operation of producing the wire harness having this kind of shielding function are performed efficiently.

A rubber boot may be mounted on a portion between the shielding shell and the shielding pipe. Opposed open ends of the rubber boot may be caulked to the shielding shell and the shielding pipe with a tightening band that has thickness equal to the thickness of the tightening band caulked to the shielding shell. The rubber boot waterproofs the portion of the wire harness that has the braided wire and can be caulked efficiently.

The invention enables the housing to be fixed to the shielding shell at a high force without making the housing large.

DETAILED DESCRIPTION OF THE PREFERRED EMBODIMENTS

Figure 1:
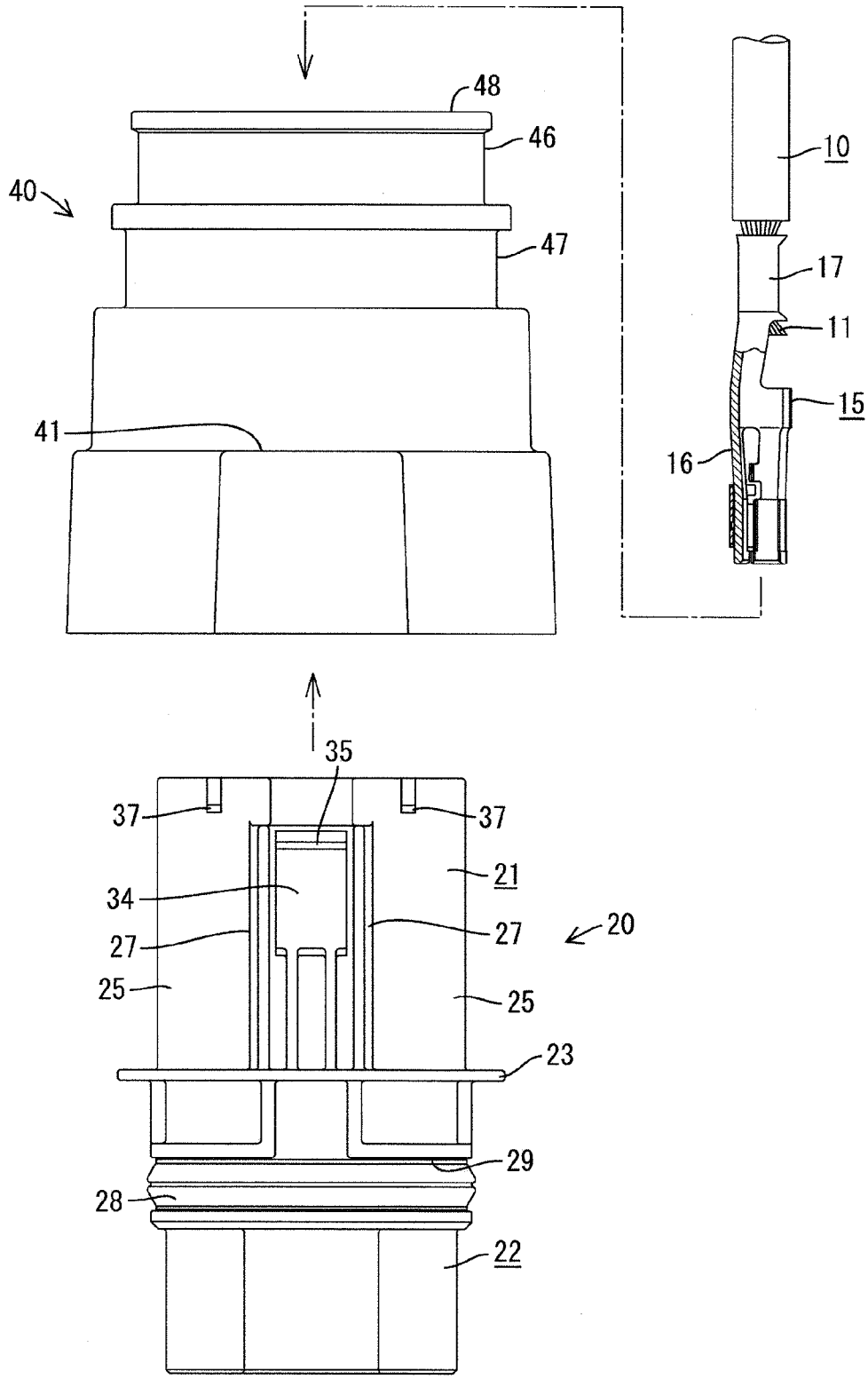
FIG. 1 is a partly cut-out front view showing a state before a shielding connector of the invention is combined with a housing.
Figure 2:
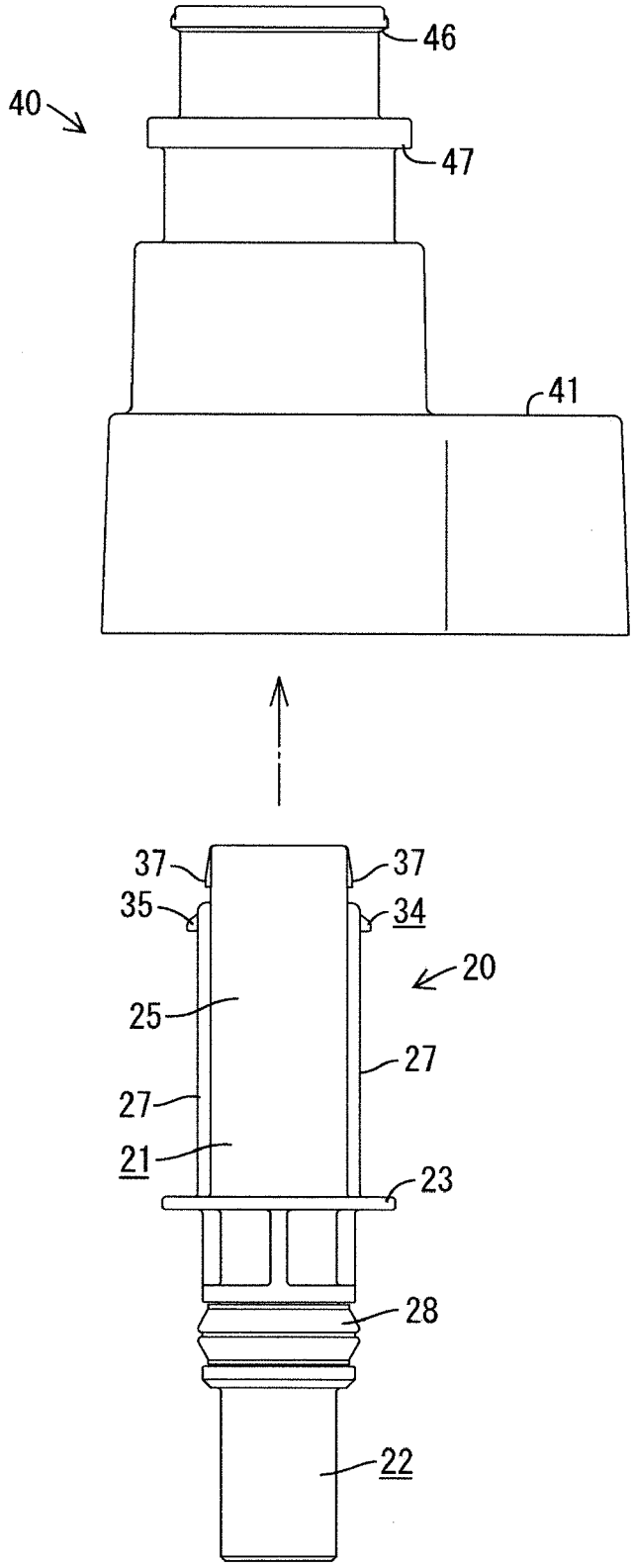
FIG. 2 is a side view of FIG. 1.

An electric wire-side shielding connector in accordance with the invention has a housing 20, a female terminal 15 accommodated in the housing 20, a covered electric wire 10 fixed to the female terminal 15 and a shielding shell 40 fit on the housing 20, as shown in FIGS. 1 and 2. The electric wire-side shielding connector is connected to an unshown mating equipment-side shielding connector by fitting them together.

The female terminal 15 is formed by press working an electrically metal plate and has a cylindrical connection part 16 for receiving a round pin of a male terminal accommodated in the unshown mating equipment-side shielding connector. A barrel 17 is disposed rearward from the connection part 16 and is caulked to a core wire 11 that has been exposed by stripping an end of the covered electric wire 10. Thus, the female terminal 15 is fixed to the end of the covered electric wire 10.

Figure 3:
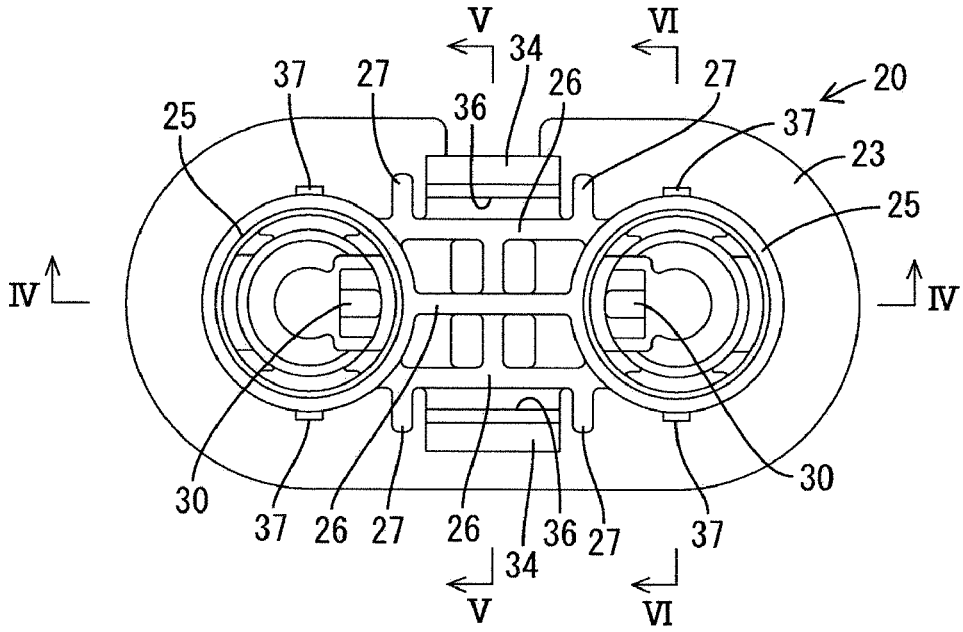
FIG. 3 is a plan view of the housing.
Figure 4:
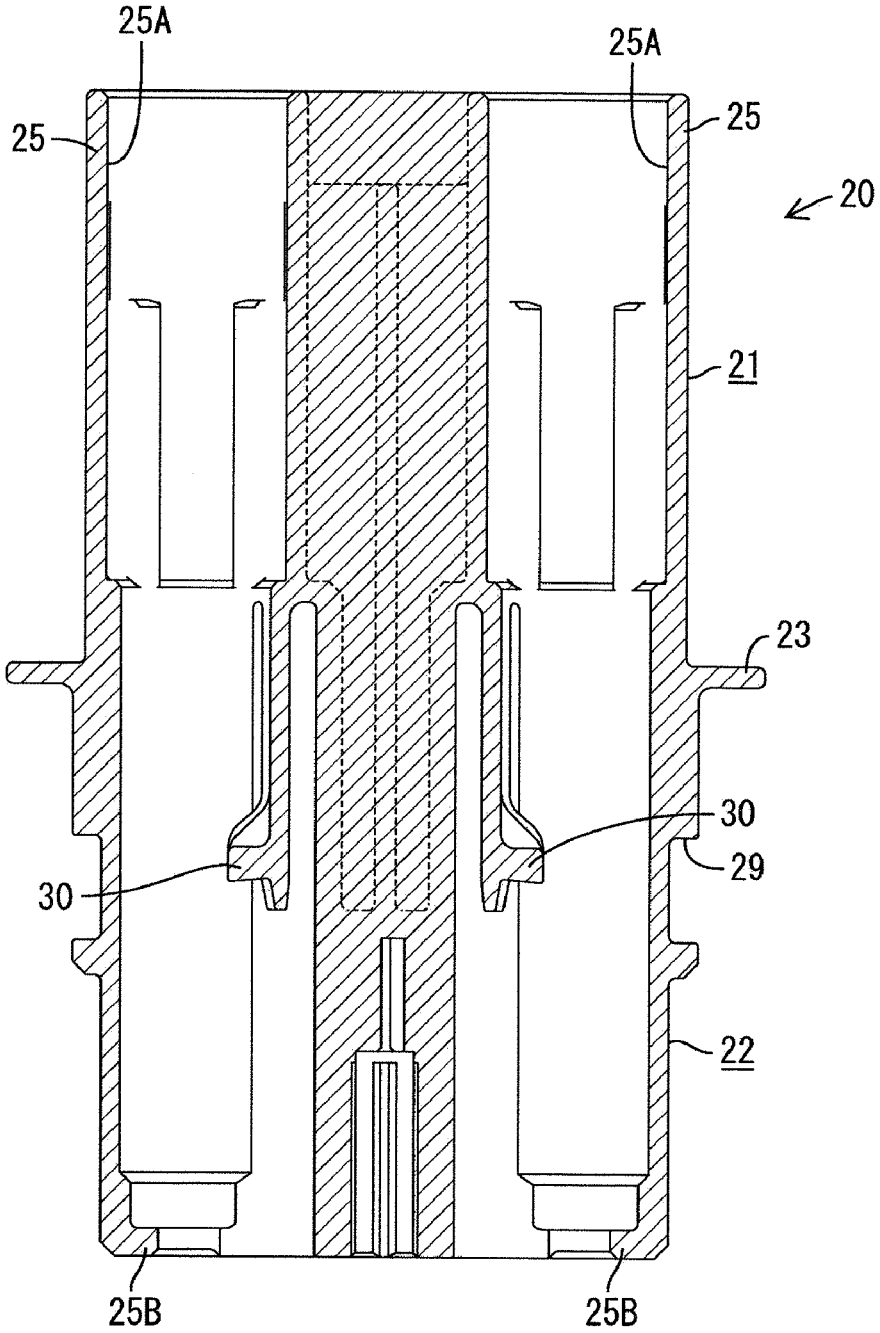
FIG. 4 is a sectional view taken along a line IV-IV of FIG. 3.
Figure 5:
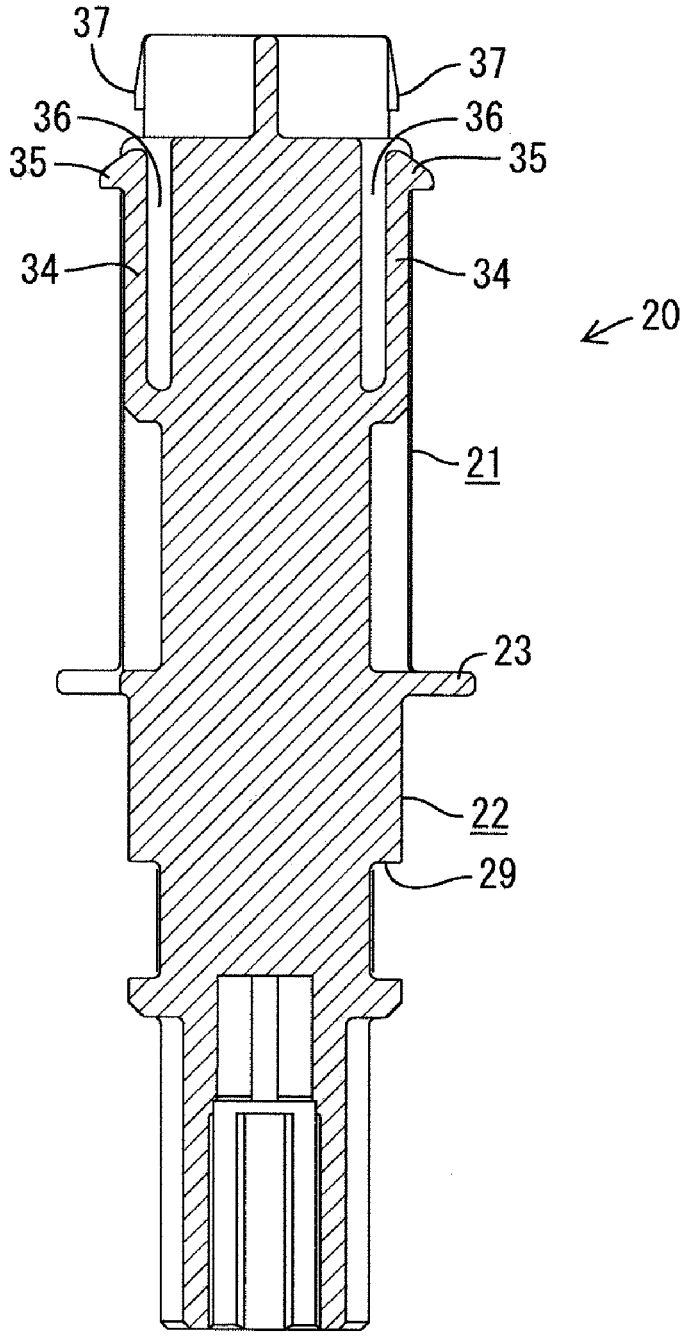
FIG. 5 is a sectional view taken along a line V-V of FIG. 3
Figure 6:
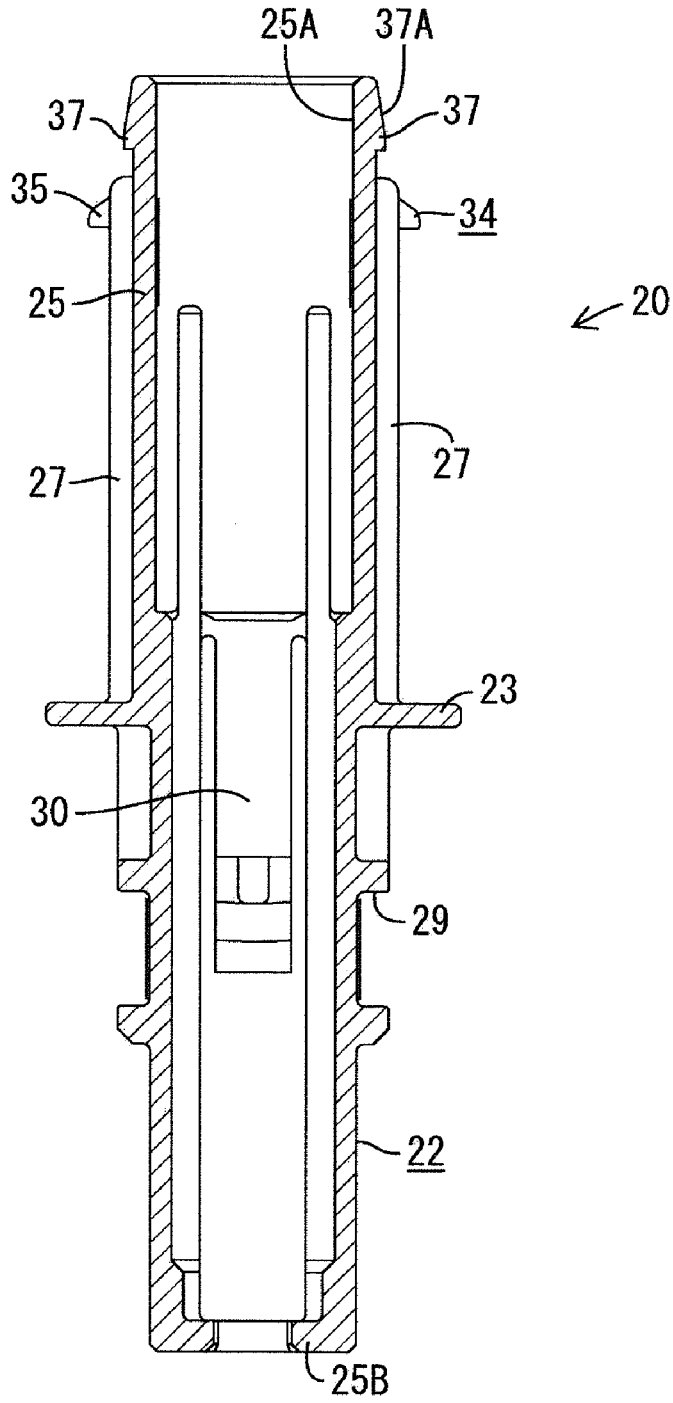
FIG. 6 is a sectional view taken along a line VI-VI of FIG. 3

The housing 20 is made of synthetic resin and has a terminal insertion end 21 and a fit-on end 22 shown respectively at the top and bottom in FIGS. 4 through 6. A flange 23 projects out from an approximately center between the opposed ends of the housing 20 in the height direction of FIGS. 4 through 6. Approximately cylindrical left and right terminal accommodation parts 25 penetrate the housing 20 longitudinally from the terminal insertion end 21 to the fit-on end 22 and the female terminals 15 are inserted into the respective terminal accommodation parts 25. Opposed surfaces of the terminal accommodation parts 25 are connected to each other by three spaced apart connection plates 26 that extend in the longitudinal direction of the housing 20, as shown in FIG. 3. Left and right guide walls 27 project from outer surfaces of the outermost connection plates 26. Peripheral surfaces of the terminal accommodation parts 25 are continuous with each other at the fit-on end 22 of the housing 20 to form an elliptic outer configuration in a plan view. Additionally, a fit-in groove 29 of a seal ring 28 is formed on the periphery of the fit-on end 22 of the housing 20 at approximately the center in the height direction and receives a seal ring 28 for sealing the gap between the housing 20 and the mating connector.

An elastically displaceable lance 30 is provided in each terminal accommodation part 25 at a position slightly below the center in the height direction. The lances 30 cantilever down and face in opposite directions. The female terminal 15 is pressed down into each terminal accommodation part 25 from an entrance 25A at an upper end thereof until the front end of the connection part 16 strikes a front wall 25B of the terminal accommodation part 25 at a lower end thereof. The lance 30 then elastically returns to its original state and locks a rear edge of the connection part 16 (see FIG. 17).

A rubber stopper 32 is fit on the entrance 25A of each terminal accommodation part 25. A retainer 50 prevents the rubber stopper 32 from being removed from the terminal accommodation part 25.

Figure 7:
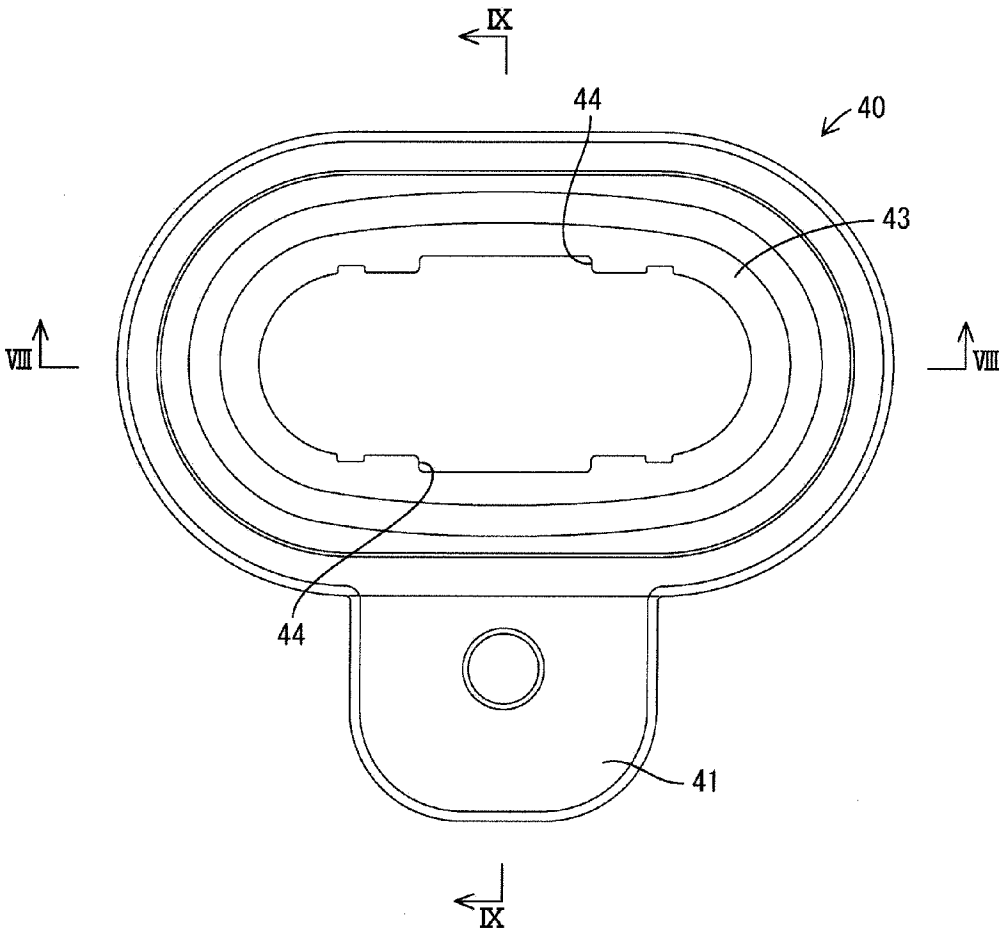
FIG. 7 is a plan view of a shielding shell.
Figure 8:
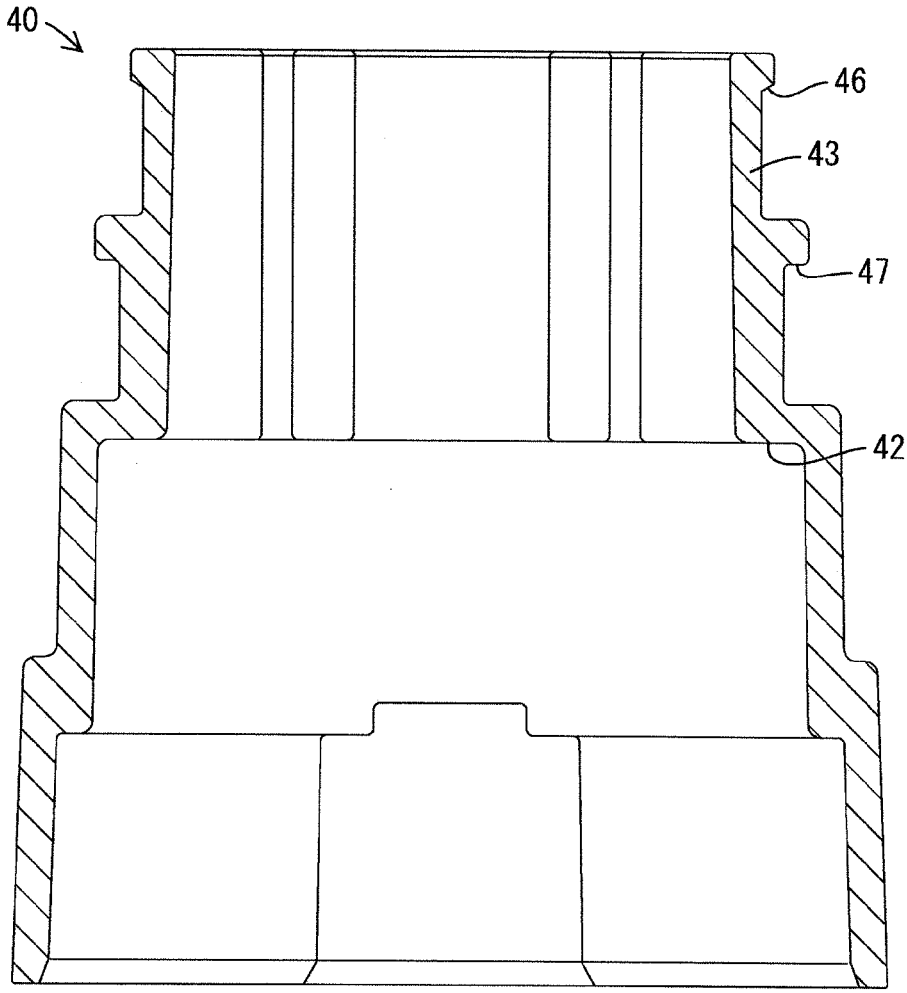
FIG. 8 is a sectional view taken along a line VIII-VIII of FIG. 7.
Figure 9:
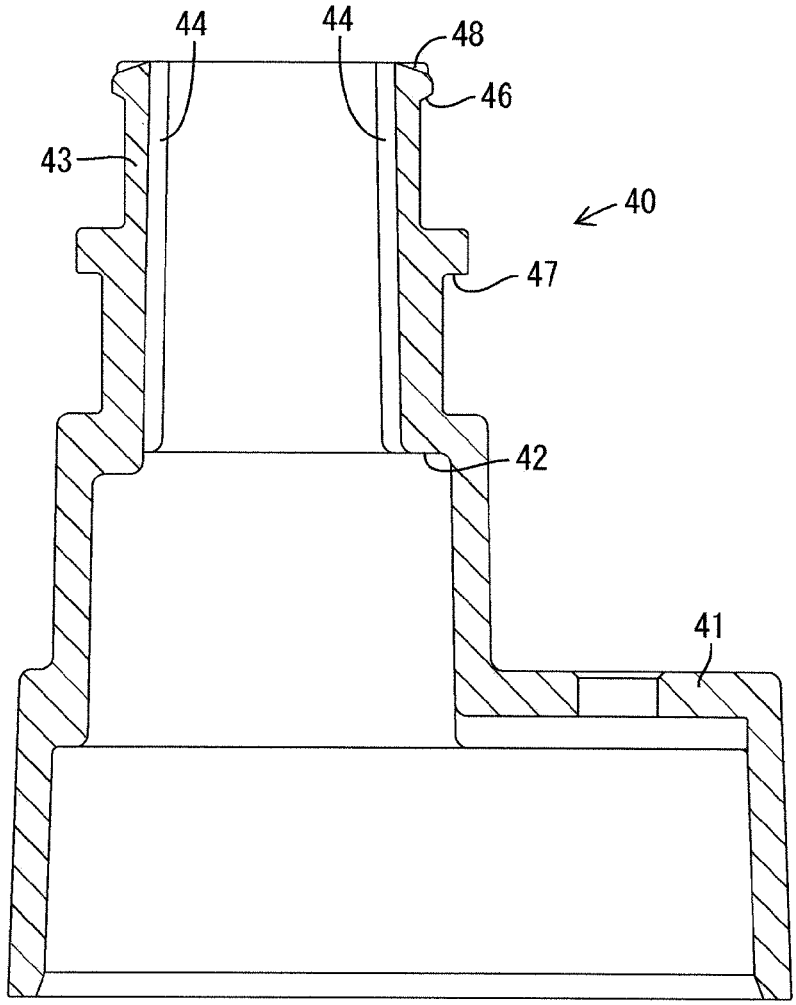
FIG. 9 is a sectional view taken along a line IX-IX of FIG. 7.

The shielding shell 40 is made of aluminum by die casting and defines a hollow elliptic tube, as shown in FIG. 7 through 9. A protrusion 41 projects from a central portion of one of two parallel surfaces at a lower portion of the shielding shell 40.

The housing 20 can be inserted into the shielding shell 40 from below. The cross section of an inner peripheral surface of the shielding shell 40 is decreased sequentially from the lower end to define three stages separated by steps. The flange 23 of the housing 20 strikes against the upper step 42. Guide grooves 44 are formed in two parallel inner peripheral surfaces of an upper stage 43 and can receive the rear guide walls 27 on the housing 20.

Front and rear elastic locking pieces 34 are formed at the terminal insertion end 21 of the housing 20. As shown in FIGS. 3 and 5, one elastic locking piece 34 is formed outward from the front connection plate 26 and between the front guide walls 27, whereas the other elastic locking piece 34 is formed outward from the rear connection plate 26 and between the rear guide walls 27. The elastic locking pieces 34 are cantilevered upward and a hook 35 projects out from an upper end of each elastic locking piece 34. The upper end of each elastic locking piece 34 can displace elastically in and out. Additionally, a flexibility-allowing space 36 is formed inward of each of the elastic locking pieces 34 for allowing the elastic locking pieces 34 to displace inward.

The terminal insertion end 21 can be pressed into the upper stage 43 of the shielding shell 40 and causes the elastic locking piece 34 to displace inward. The pressing operation is stopped when the flange 23 strikes the upper step 42. At this time, the hook 35 of the elastic locking piece 34 passes a upper open edge 48 of the shielding shell 40. As a result, the elastic locking piece 34 flexibly restores to its original state, and the hook 35 locks to the upper open edge 48 of the shielding shell 40. Thus, the housing 20 is prevented from being removed from the shielding shell 40.

The retainer 50 is mounted on the upper open edge 48 of the housing 20. The retainer 50 functions both to redundantly prevent the housing 20 from being removed from the shielding shell 40 and to hold down the rubber stopper 32, as described above.

As shown in FIGS. 10 through 13, the retainer 50 is made of synthetic resin and has an approximately elliptic substrate 51 for covering an end surface of the terminal insertion end 21 of the housing 20. Two cylindrical hold-down parts 52 project from a rear surface of the substrate 51 at opposite ends of the substrate 51 and can fit entrances 25A of the terminal accommodation parts 25. Retainer plates 53 project rearward from central portions of the front and rear straight portions of the rear substrate 51 and can be inserted into the flexibility-allowing space 36 of the elastic locking piece 34 of the housing 20.

The retainer 50 has two parts 50A separate from each other with respect to a longitudinal center line. A hinge 55 at one longitudinal end of the retainer 50 couples the two parts 50A to each other so that the two parts 50A can be opened and closed.

Four locking legs 57 project from the rear surface of the substrate 51 of the retainer 50 and each locking leg 57 has a locking groove 58 open at an upper edge thereof. The locking legs 57 are disposed respectively at front and rear edges of both sides of each hold-down part 52. Front and rear locking projections 37 and 38 project from outer surfaces of the entrances 25A of the terminal accommodation parts 25, as shown in FIG. 6. The locking projections 37 can fit in the locking grooves 58 of the locking legs 57 and engage a lower end of the respective locking groove 58. A tapered surface 37A is formed on an upper part of each locking projection 37.

Figure 14:
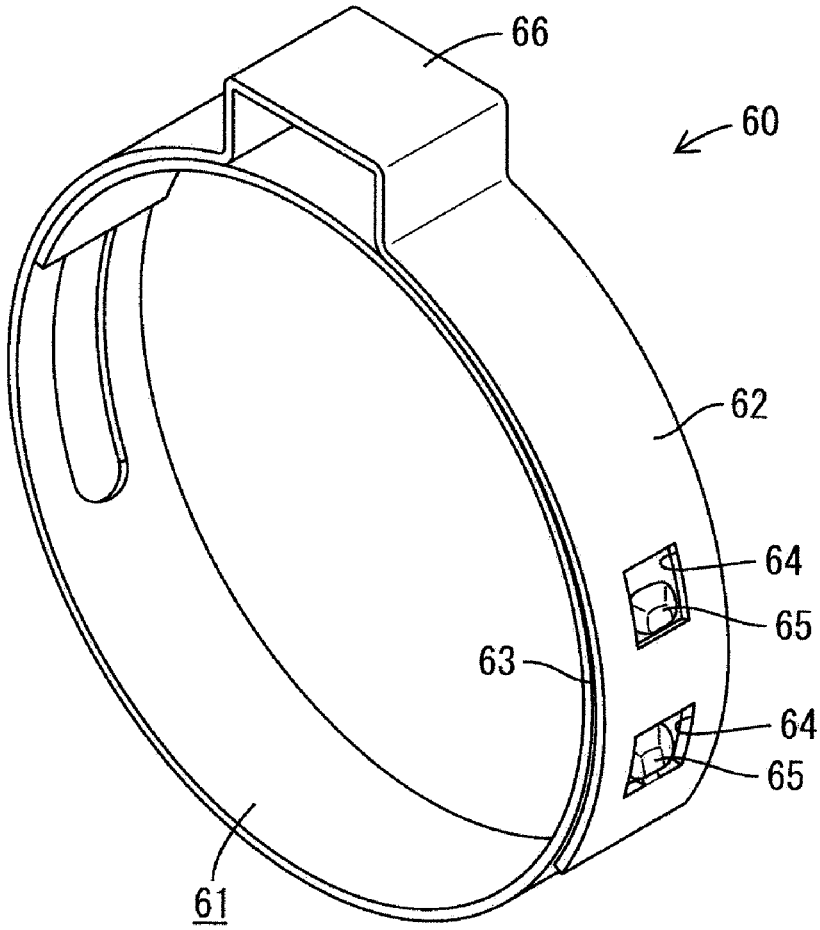
FIG. 14 is a perspective view of a tightening band.

A mounting groove 46 is formed at the upper end of the peripheral surface of the shielding shell 40 and an open end 70A of a braided wire 70 fit on two covered electric wires 10 can be mounted to the mounting groove 46. A tightening band 60 caulks the open end 70A of the braided wire 70 to the mounting groove 46 of the shielding shell 40. The ring-shaped tightening band 60 has a metal band 61 with opposite outer and inner sections 62 and 63 that overlap, as shown in FIG. 14. Two locks 65 project from the inner section 63 and fit respectively in locking holes 64 formed in the outer section 62. An inverted U-shaped tightening ear 66 is bent outward on the outer section 62.

The diameter of the tightening band 60 can be decreased by crushing the tightening ear part 66 with a tightening tool such as pliers. It is possible to caulk plural tightening bands 60 of different diameters in this manner with the tightening tool so long as the bands 60 have an equal thickness.

A boot-mounting groove 47 where an open end 72A of a rubber boot 72 is to be fit is formed on an upper-side peripheral surface of the shielding shell 40 at a position below the mounting groove 46 for the braided wire 70. The open end 72A of the rubber boot 72 is fixed to the boot-mounting groove 47 by caulking it with a tightening band 60B. A bolt 49 for helping connection between the electric wire-side shielding connector and the mating connector is rotatably mounted on a ceiling of the protruded part 41 formed at the lower end of the shielding shell 40.

A detection terminal 24 is mounted on the lower surface of the housing 20 and defines an interlocking mechanism for electrically detecting the fit-on connection state between the electric wire-side shielding connector and the mating connector.

A procedure for assembling the electric wire-side shielding connector C from the component parts is described below.

The seal ring 28 and the detection terminal 24 of the interlocking mechanism are mounted on the housing 20 in advance and the bolt 49 is mounted on the protrusion 41 of the shielding shell 40 in advance. The housing 20 then is inserted into the shielding shell 40 from below. More particularly, the terminal insertion end 21 is pressed into the upper stage 43 of the shielding shell 40 and flexibly displaces both elastic locking pieces 34 while being guided with the guide groove 44.

Figure 15:
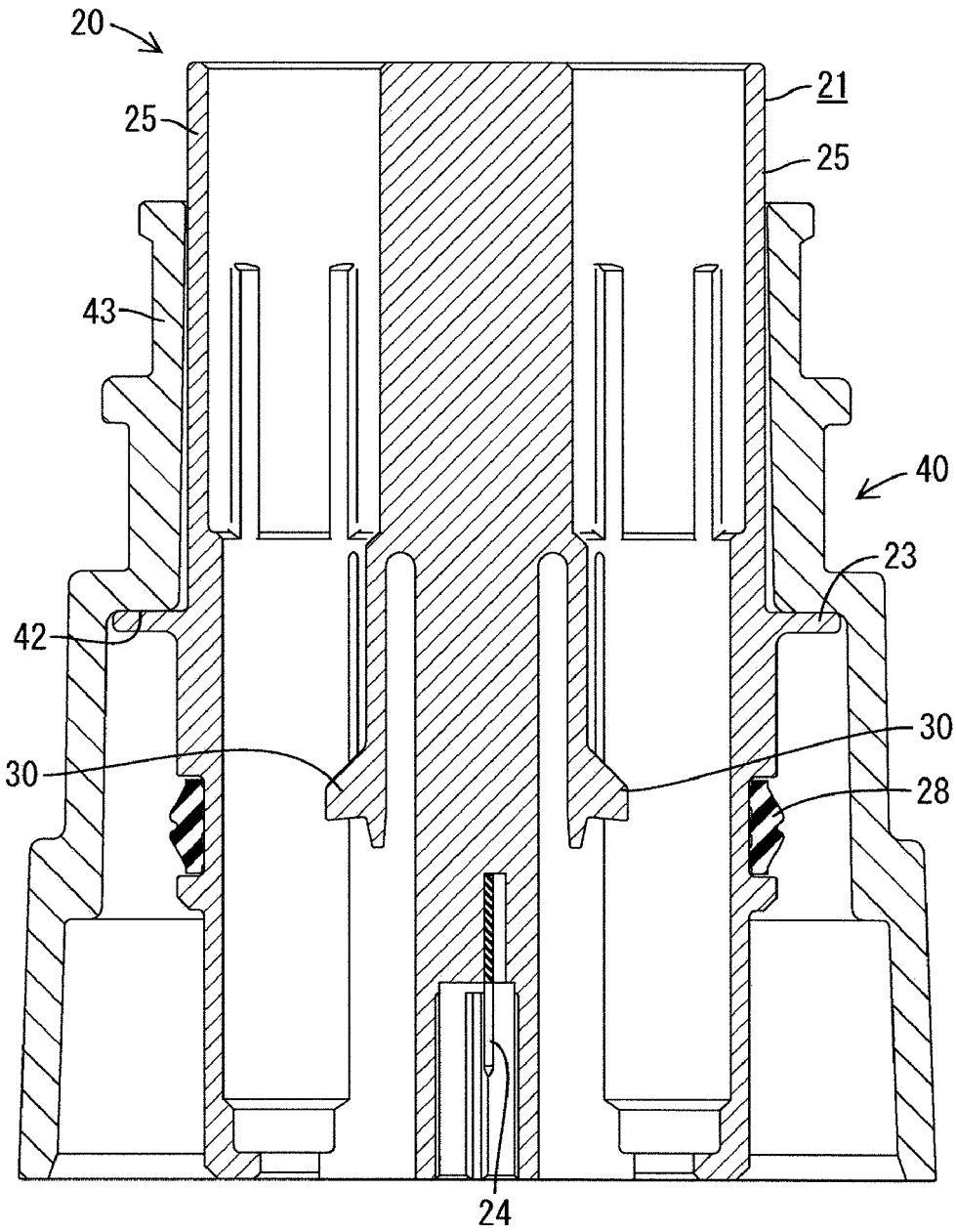
FIG. 15 is a front sectional view showing a state in which the housing is combined with the shielding shell.
Figure 16:
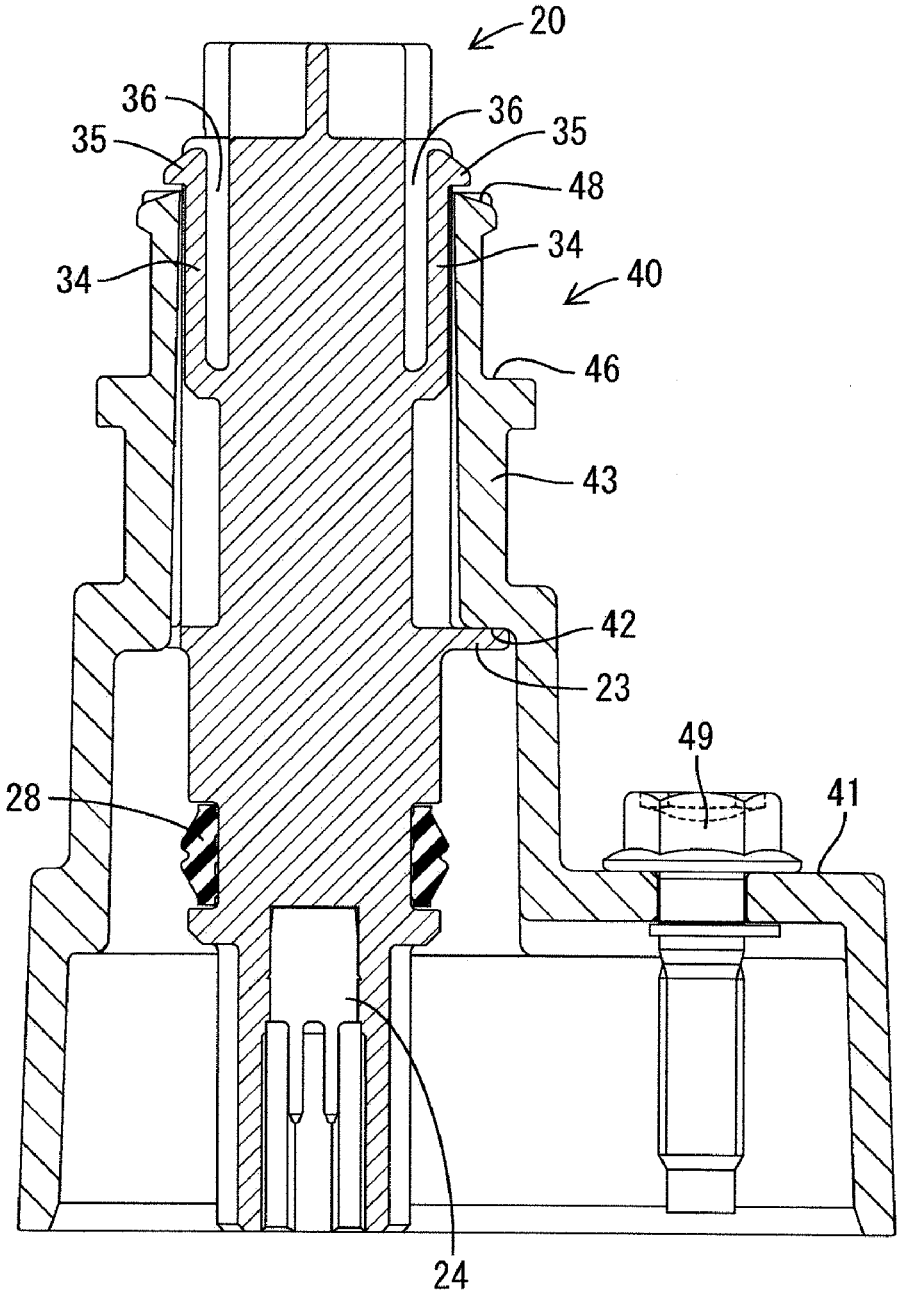
FIG. 16 is a side sectional view of FIG. 15.

The operation of pressing the housing 20 is stopped when the flange 23 on the periphery of the housing 20 strikes the step 42 on the inner periphery of the shielding shell 40, as shown in FIGS. 15 and 16. At this time, the elastic locking piece 34 flexibly restores to its original state so that the hook 35 locks to the upper open edge 48 of the shielding shell 40 and prevents the housing 20 from being removed from the shielding shell 40.

Figure 17:
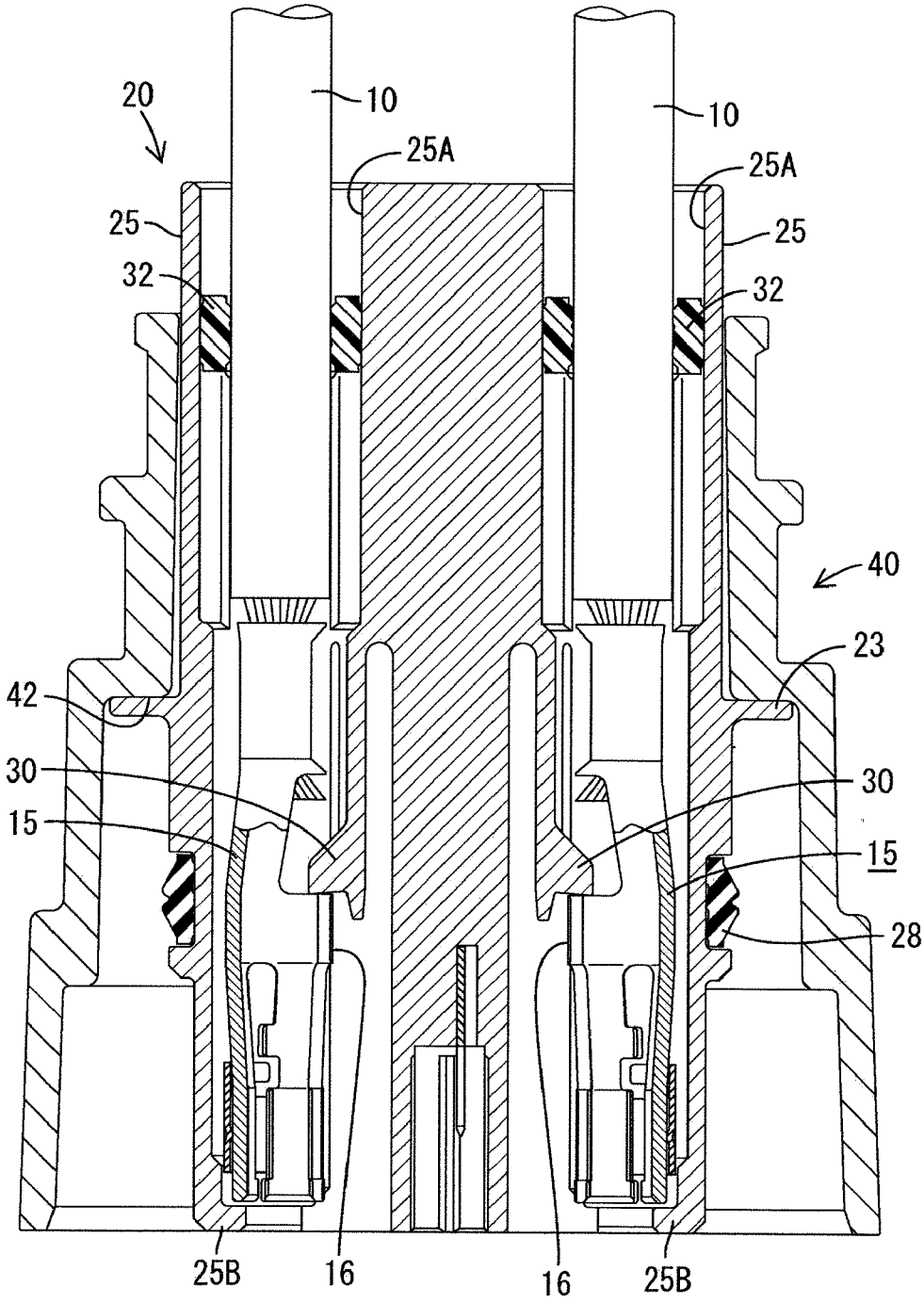
FIG. 17 is a front sectional view showing a state in which a female terminal and a rubber stopper are mounted on the housing.

The female terminals 15 fixed to the end of the covered electric wires 10 then are inserted into the terminal accommodation parts of the housing 20 with the female terminals 15 facing a predetermined direction. As a result, each female terminal 15 flexibly deforms the lance 30 until the front end of the connection part 16 contacts the front wall 25B, as shown in FIG. 17. The lance 30 then elastically restores to its original state and locks the connection part 16. The rubber stopper 32 mounted on each of the covered electric wires 10 in advance then is fit on the entrance 25A of the terminal accommodation part 25.

Figure 10:
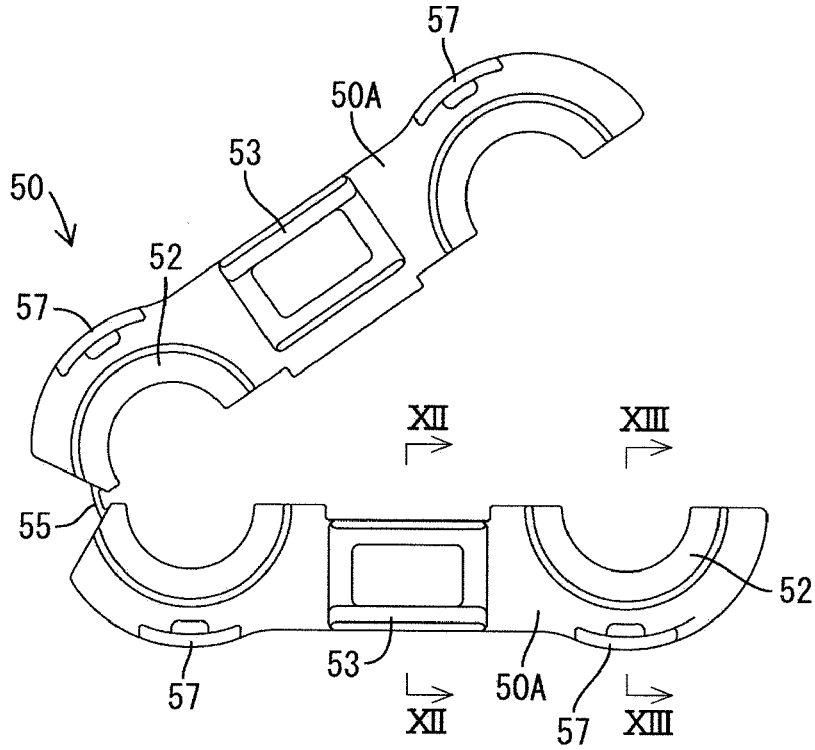
FIG. 10 is a plan view of a retainer which is open.
Figure 11:
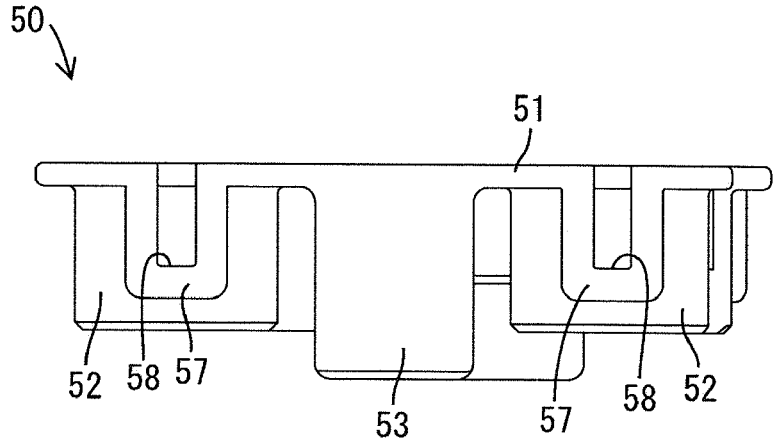
FIG. 11 is a rear view of FIG. 10.
Figure 12:
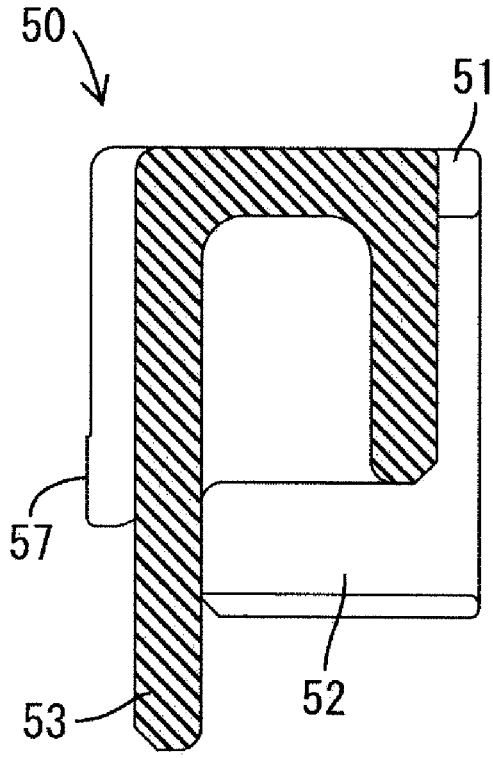
FIG. 12 is an enlarged sectional view taken along a line XII-XII of FIG. 10.
Figure 13:
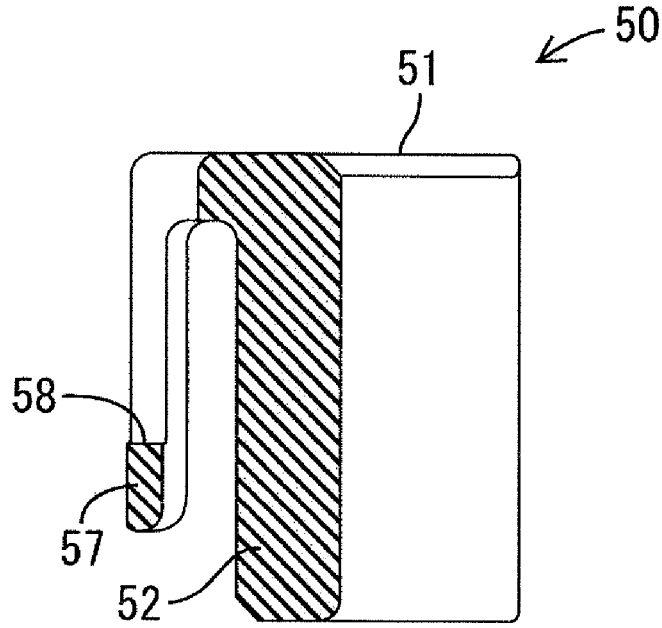
FIG. 13 is an enlarged sectional view taken along a line XIII-XIII of FIG. 10.
Figure 18:
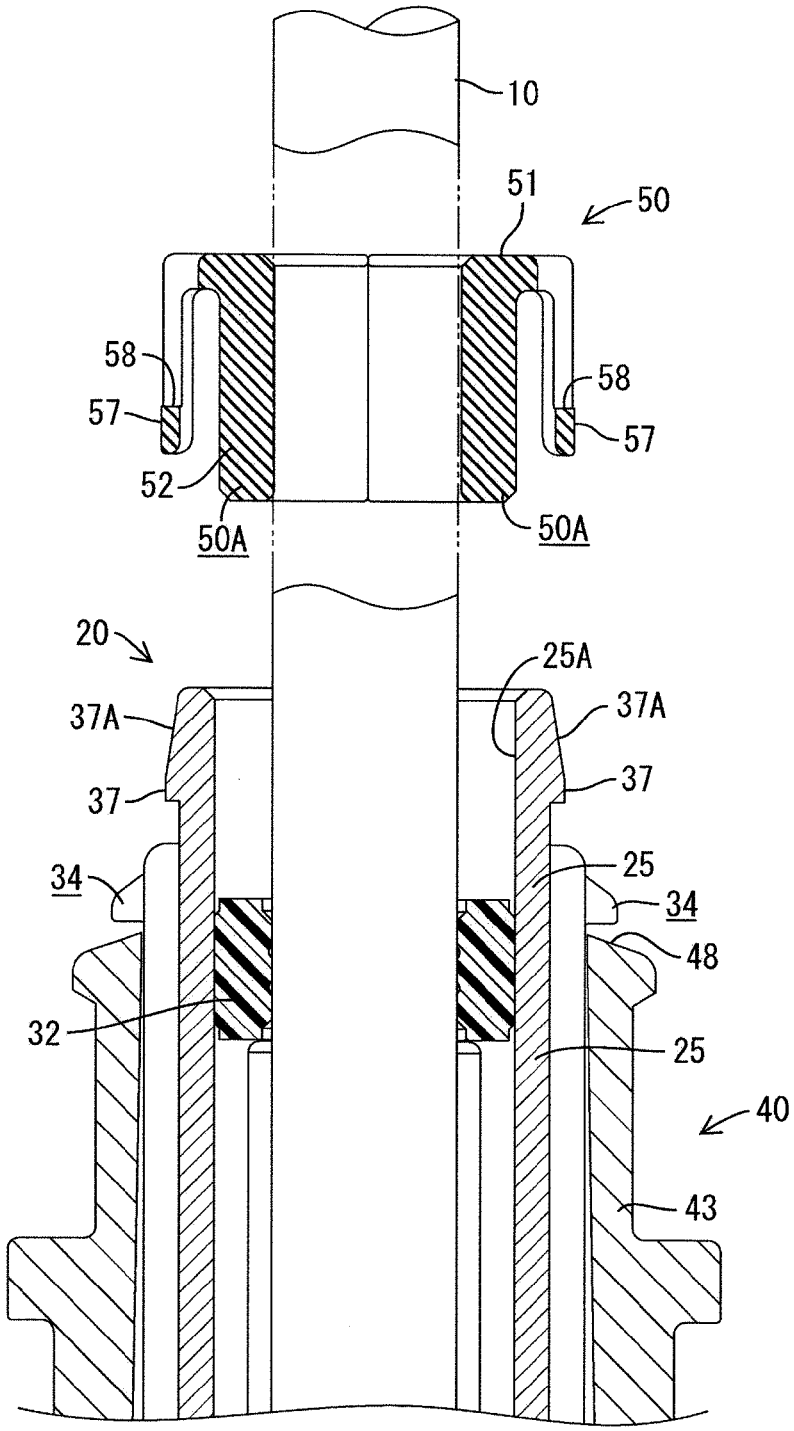
FIG. 18 is a partial sectional view showing an operation of mounting the retainer on the housing.

The retainer 50 in the open state shown in FIG. 10 then is mounted so that the covered electric wires 10 are fit between the separate hold-down parts 52. The retainer 50 then is closed on around covered electric wires 10, as shown in FIG. 18, and is slid along the covered electric wires 10 toward the upper end of the housing 20.

The locking leg 57 of the retainer 50 strikes the tapered surface 37A of the locking projection 37 of the housing 20 and is pressed down with the retainer 50 elastically opening. As a result, the hold-down part 52 penetrates into the entrance 25A of the terminal accommodation part 25 with the retainer plate 53 penetrating into the flexibility-allowing space 36 disposed inward from the elastic locking piece 34.

Figure 19:
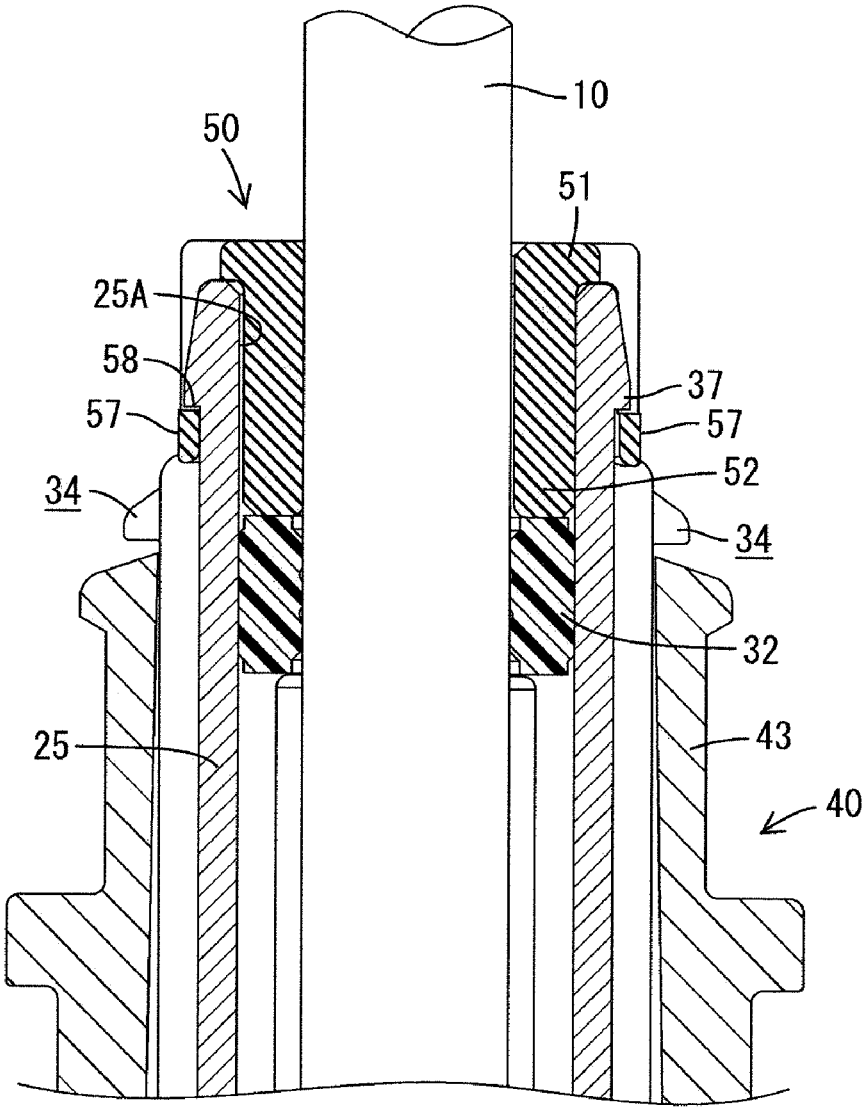
FIG. 19 is a partly sectional view showing a state in which the retainer is mounted on the housing and is locked.

The retainer 50 is pressed down until the substrate 51 strikes the upper end of the housing 20, as shown in FIG. 19.

As a result the locking leg 57 resiliently returns to its original state. Thus, the locking projection 37 fits in the locking groove 58 and the lower end of the locking groove 58 is locked to the locking projection 37 so that the retainer 50 is mounted on the housing 20 in a removal-prevented state.

Figure 20:
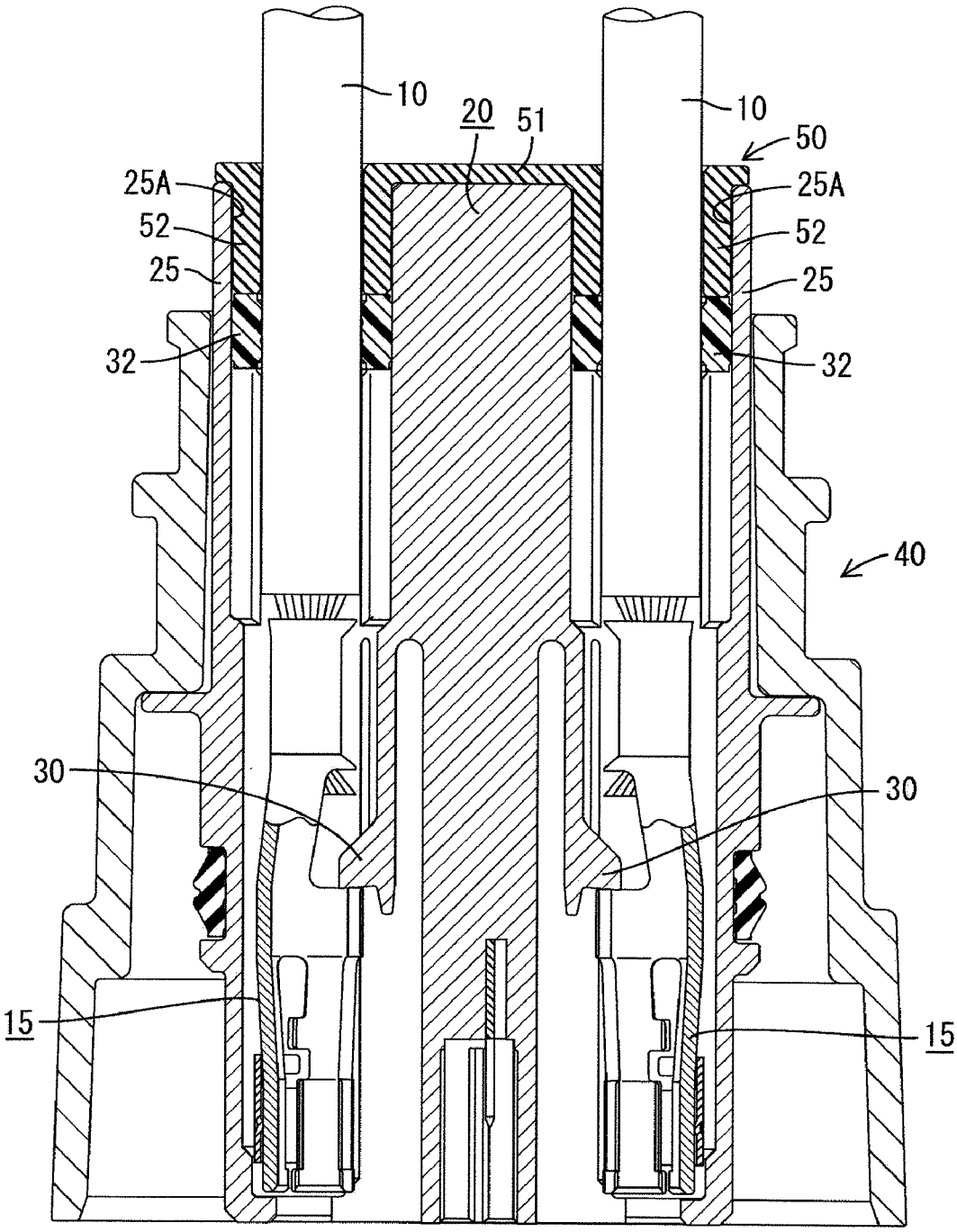
FIG. 20 is a front sectional view showing a state in which the retainer is mounted on the housing.
Figure 21:
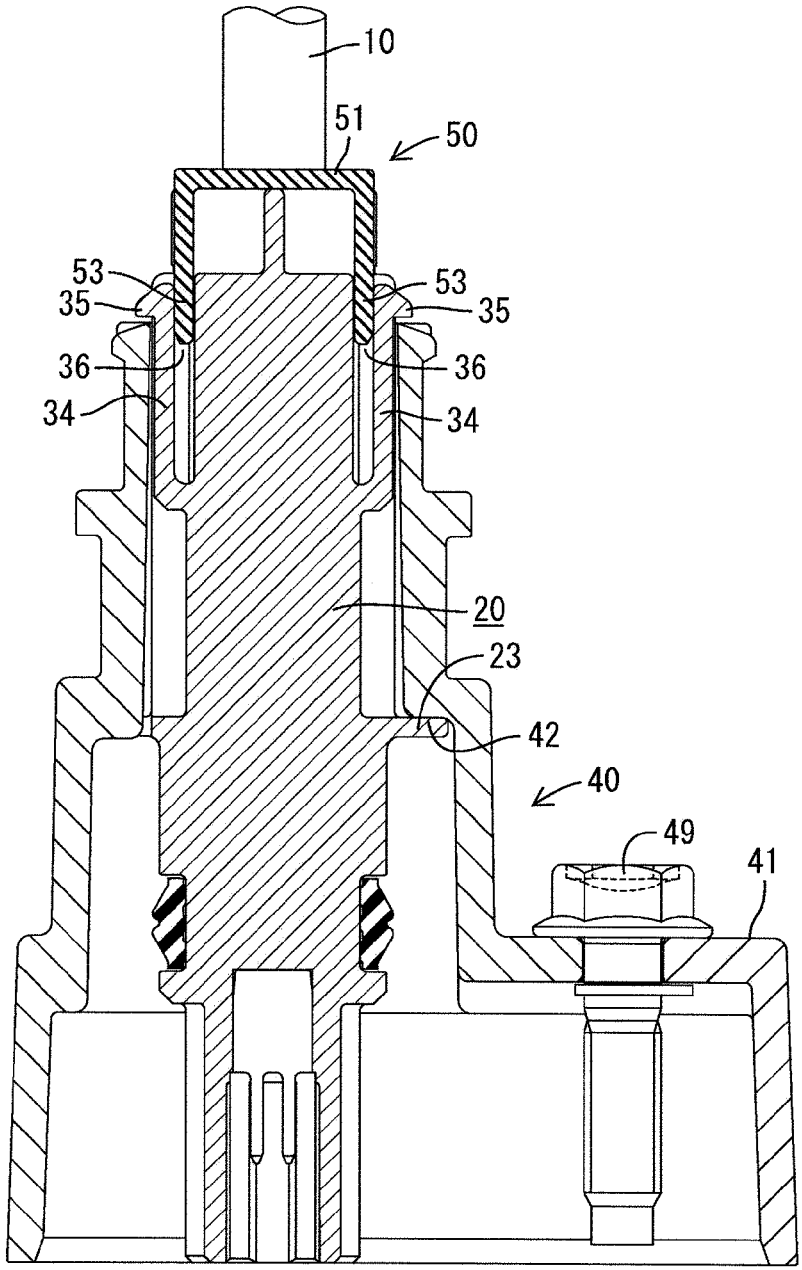
FIG. 21 is a side sectional view showing a state in which the retainer is mounted on the housing.

As shown in FIG. 20, the hold-down part 52 holds down the upper surface of the rubber stopper 32 to prevent the rubber stopper 32 from being removed from the terminal accommodation part 25. At the same time, as shown in FIG. 21, the retainer plate 53 penetrates into the flexibility-allowing space 36 and prevents the elastic locking piece 34 from flexibly displacing in an unlocking direction. Thus the retainer 50 is locked doubly.

Figure 22:
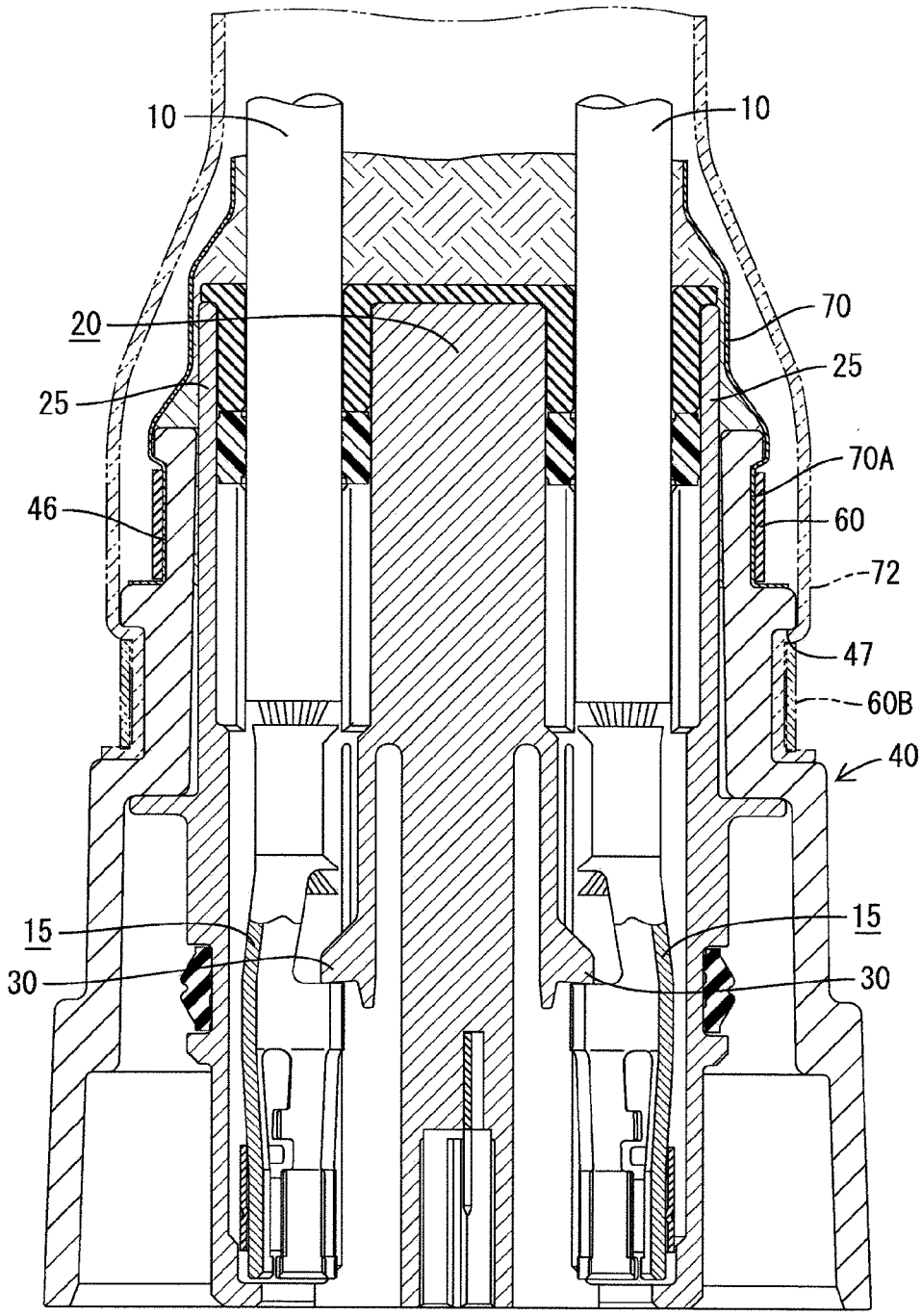
FIG. 22 is a front sectional view showing a state in which a braided wire is fixed to the shielding shell.
Figure 23:
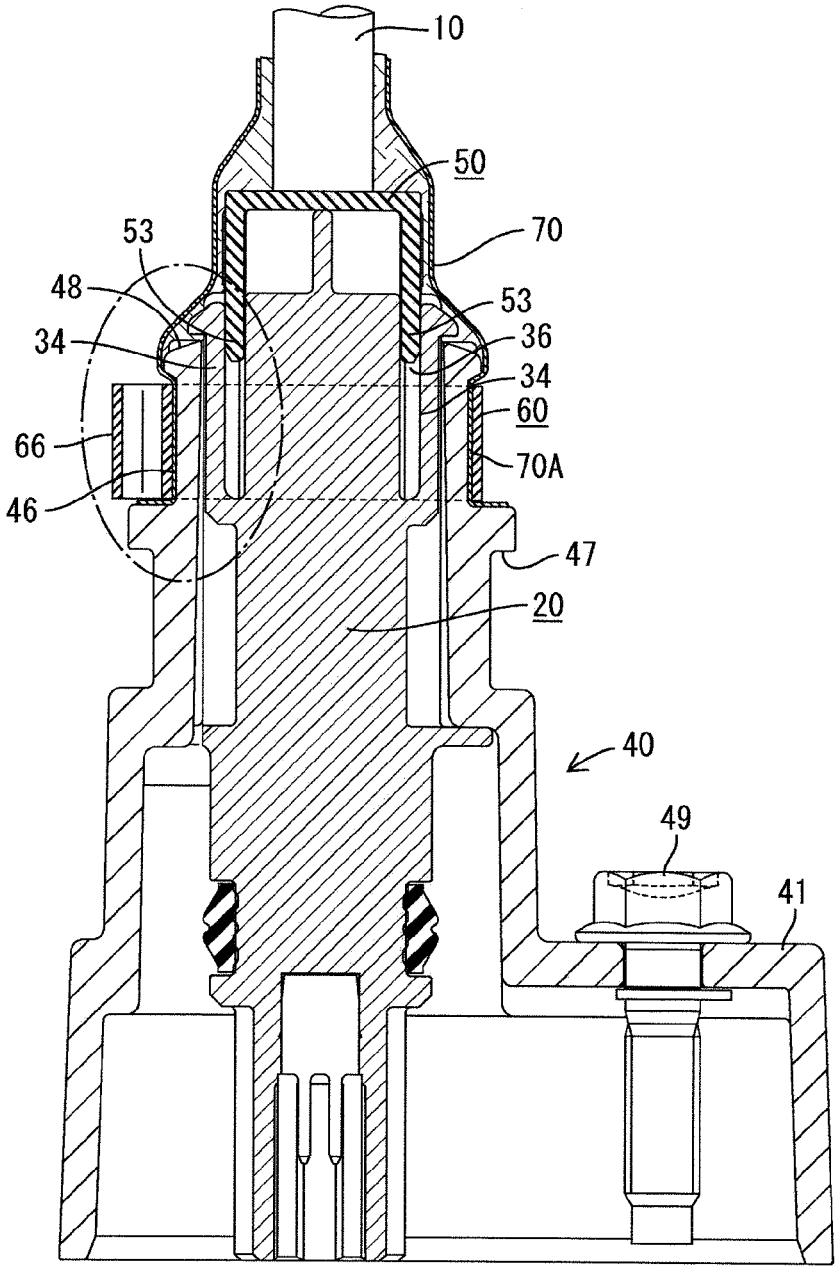
FIG. 23 is a side sectional view of FIG. 22.
Figure 24:
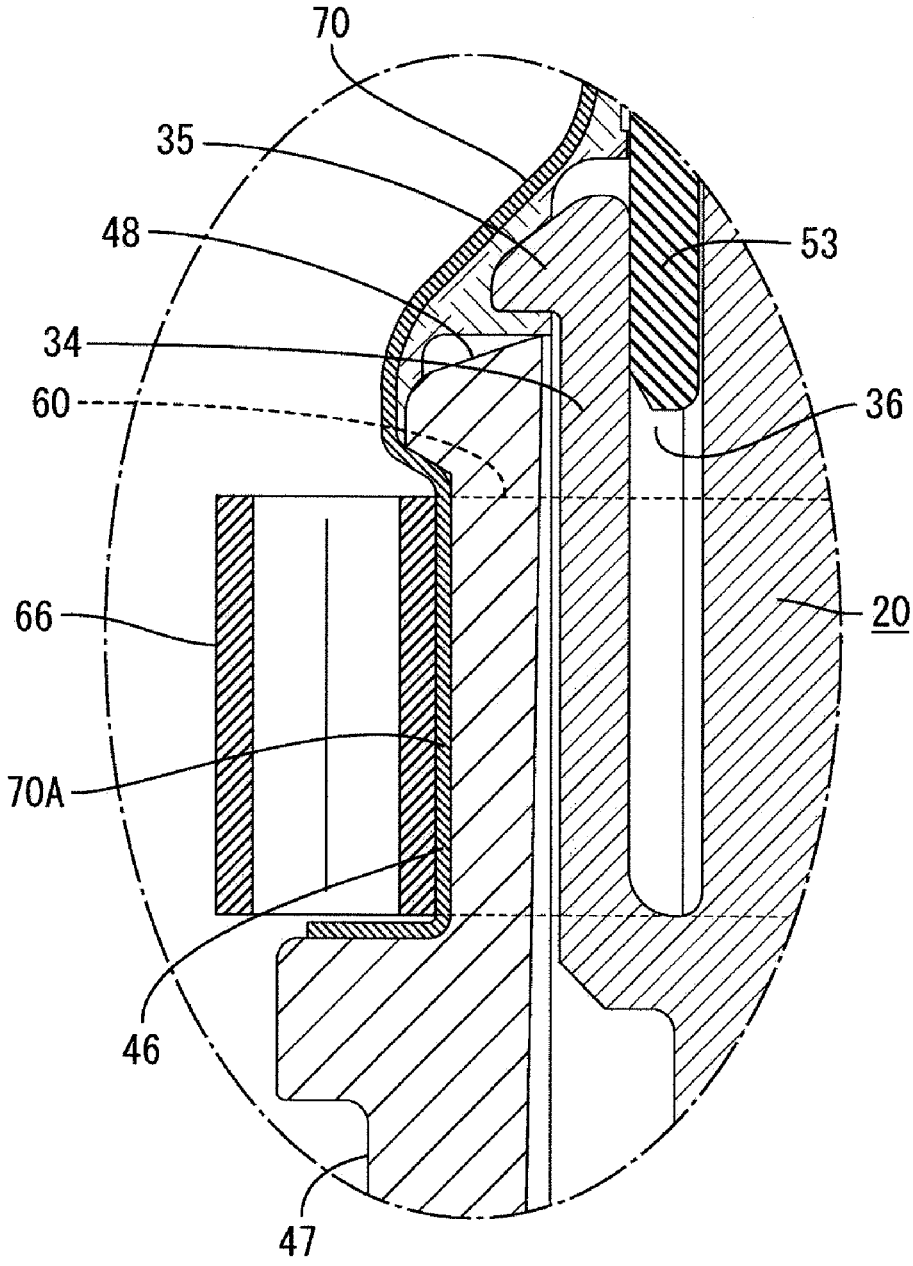
FIG. 24 is a partly enlarged view of FIG. 23.

One open end 70A of the braided wire 70 fit around both covered electric wires 10 is placed on the mounting groove 46 of the shielding shell 40 after the retainer 50 is mounted on the housing 20. The tightening band 60 then is fit around the braided wire 70 and in the mounting groove 46, as shown in FIGS. 22 through 24. The tightening ear 66 of the tightening band 60 then is clamped and caulked with a tightening tool so that the end 70A of the braided wire 70 is fixed to the mounting groove 46 to complete assembly of the connector C.

Figure 25:
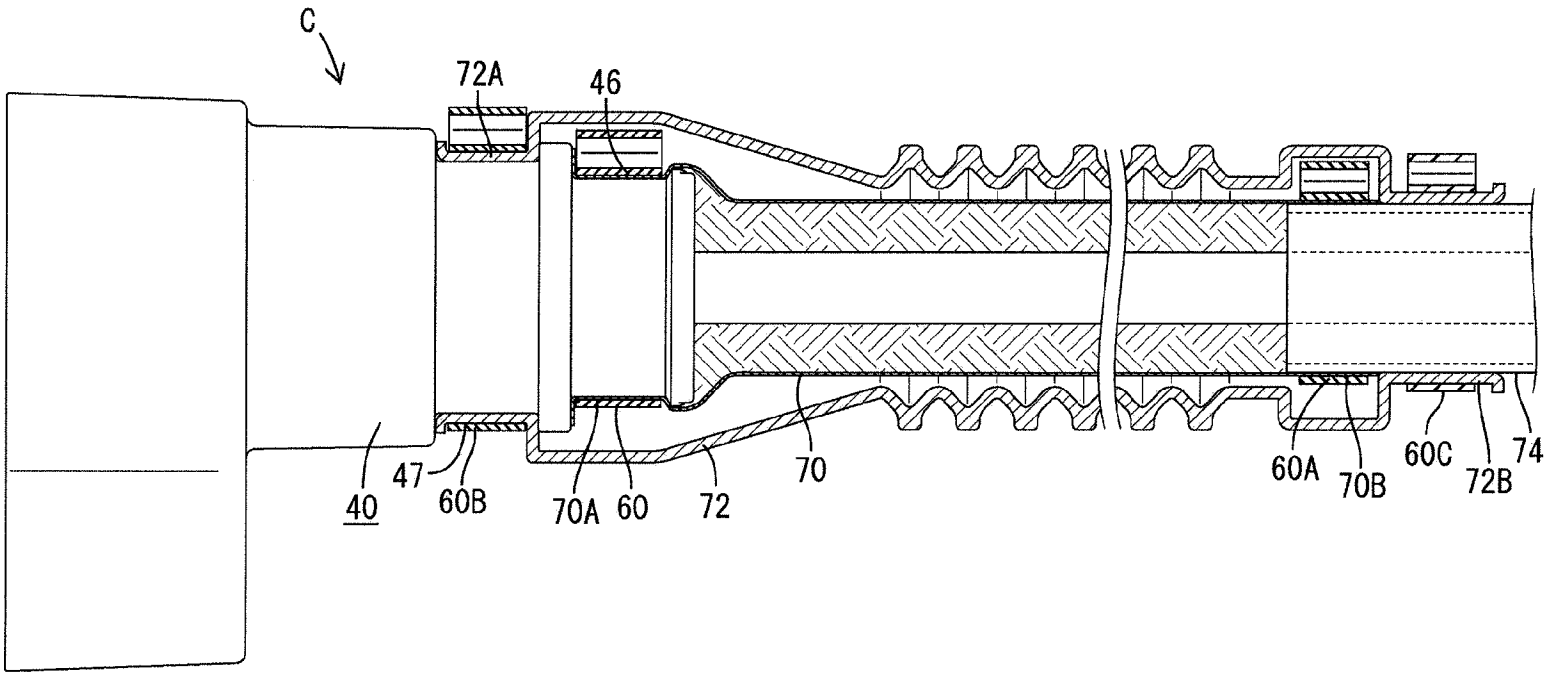
FIG. 25 is a partly cut-out side view showing a wire harness.

The wire harness shown in FIG. 25 shields the periphery of the covered electric wire 10 with flexible workability in fitting the electric wire-side shielding connector C on the mating equipment-side shielding connector. One part of the wire harness is surrounded with the braided wire 70 while an adjacent part is inserted through a metal shielding pipe 74.

More specifically, as described above, one open end 70A of the braided wire 70 is fixed to the mounting groove 46 of the shielding shell 40 with the tightening band 60, whereas the other open end 70B of the braided wire 70 is placed on an end of the shielding pipe 74 so as to cover the end of the shielding pipe 74 and fixed to the end thereof by caulking the tightening band 60A. It is preferable to wind a tape around the fixed portions of both open ends 70A, 70B of the braided wire 70.

The rubber boot 72 is mounted on the portion of the wire harness where the braided wire 70 is disposed to waterproof the wire harness. One open end 72A of the rubber boot 72 is fitted on the boot-mounting groove 47 formed on the shielding shell 40 and fixed thereto by caulking the tightening band 60B. The other open end 72B of the rubber boot 72 is placed inward from the position of the end of the shielding pipe 74, where the braided wire 70 is fixed and fastened to the shielding pipe 74 by caulking a tightening band 60C.

The tightening band 60A used to fix the braided wire 70 to the shielding pipe 74 and the tightening bands 60B, 60C used to fix ends of the rubber boot 72 have different diameters than the tightening band 60 used to fix the braided wire 70 to the shielding shell 40. However, the thicknesses of the tightening bands 60, 60A, 60B, and 60C are equal.

As described above, the electric wire-side shielding connector C mounts the retainer 50 on the housing 20 so that the elastic locking piece 34 is locked doubly and prevented from flexibly displacing in the unlocking direction. Therefore, the force of fixing the housing 20 to the shielding shell 40 is increased greatly. The retainer 50 also functions to hold down the rubber stopper 32 to simplify the construction of the connector C.

The diameter of the tightening band 60 can be decreased with a tool for caulking the open end 70A of the braided wire 70. The tightening band 60 eliminates the need for the use of a core and can be caulked with a tool by performing only an external operation. The method of assembling the electric wire-side shielding connector includes inserting the housing 20 into the shielding shell 40, primarily locking the housing 20 by the elastic locking piece 34, mounting the retainer 50 on the housing 20 to doubly lock the housing 20, covering the mounting groove 46 of the shielding shell 40 with the open end 70A of the braided wire 70, and finally fitting the tightening band 60 in the mounting groove 46 to caulk the open end 70A of the braided wire by performing the external operation with the tool for doubly locking the housing 20.

A predetermined length of the covered electric wires 10 of the wire harness is collectively surrounded by the braided wire 70 at an end that is to be connected to the shielding connector C. A portion of the wire harness adjacent the predetermined length is surrounded with the shielding pipe 74. The periphery of the braided wire 70 is covered with the rubber boot 72 to waterproof the braided wire 70. Ends of the braided wire 70 and ends of the rubber boot 72 are fixed to the shielding shell 40 and the shielding pipe 74 by tightening bands 60, 60A, 60B, and 60C that can be operated with a tool. The diameters of the tightening bands 60, 60A, 60B, and 60C may be different, but the thicknesses of the tightening bands 60, 60A, 60B, and 60C are equal. Thus, the above-described caulking operations eliminate the need for the use of a large-scale die device and can be performed by operating the tool. It is possible to perform the operation of decreasing the diameter of the tightening bands with the same tool when the tightening bands have an equal thickness, even though the diameters thereof are different from each other. Therefore it is possible to efficiently perform the operation of caulking the braided wire 70 and the rubber stopper 72 and the operation of producing the wire harness having this kind of shielding function.

A second embodiment of the invention is described below with reference to FIGS. 26 and 27.

The construction of the first embodiment for preventing a retainer 80 from being removed from the housing 20 is altered in the second embodiment. The parts of the second embodiment having the same function as the first embodiment are denoted as the same reference numerals, but the description thereof is omitted or simplified herein.

Figure 26:
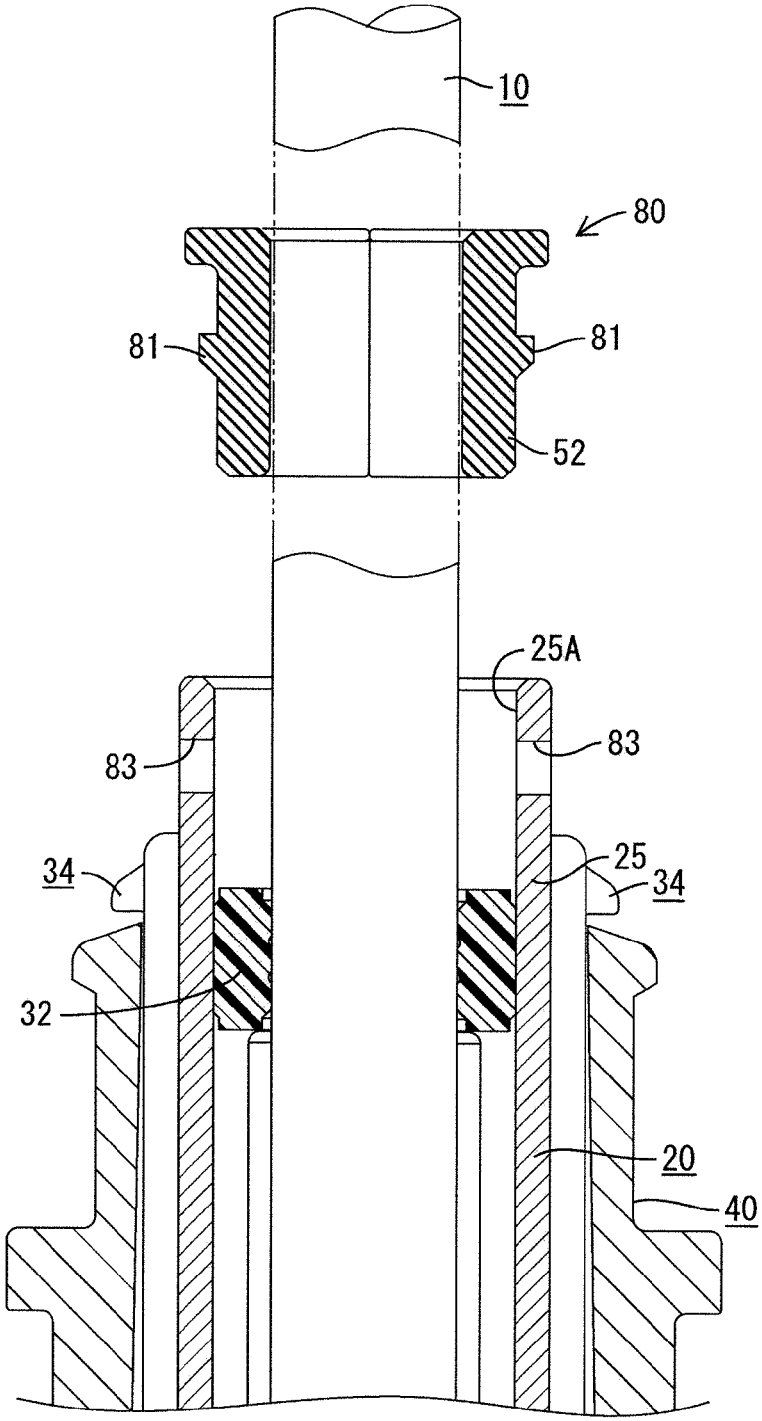
FIG. 26 is a partial sectional view of a second embodiment showing a retainer-mounting operation.
Figure 27:
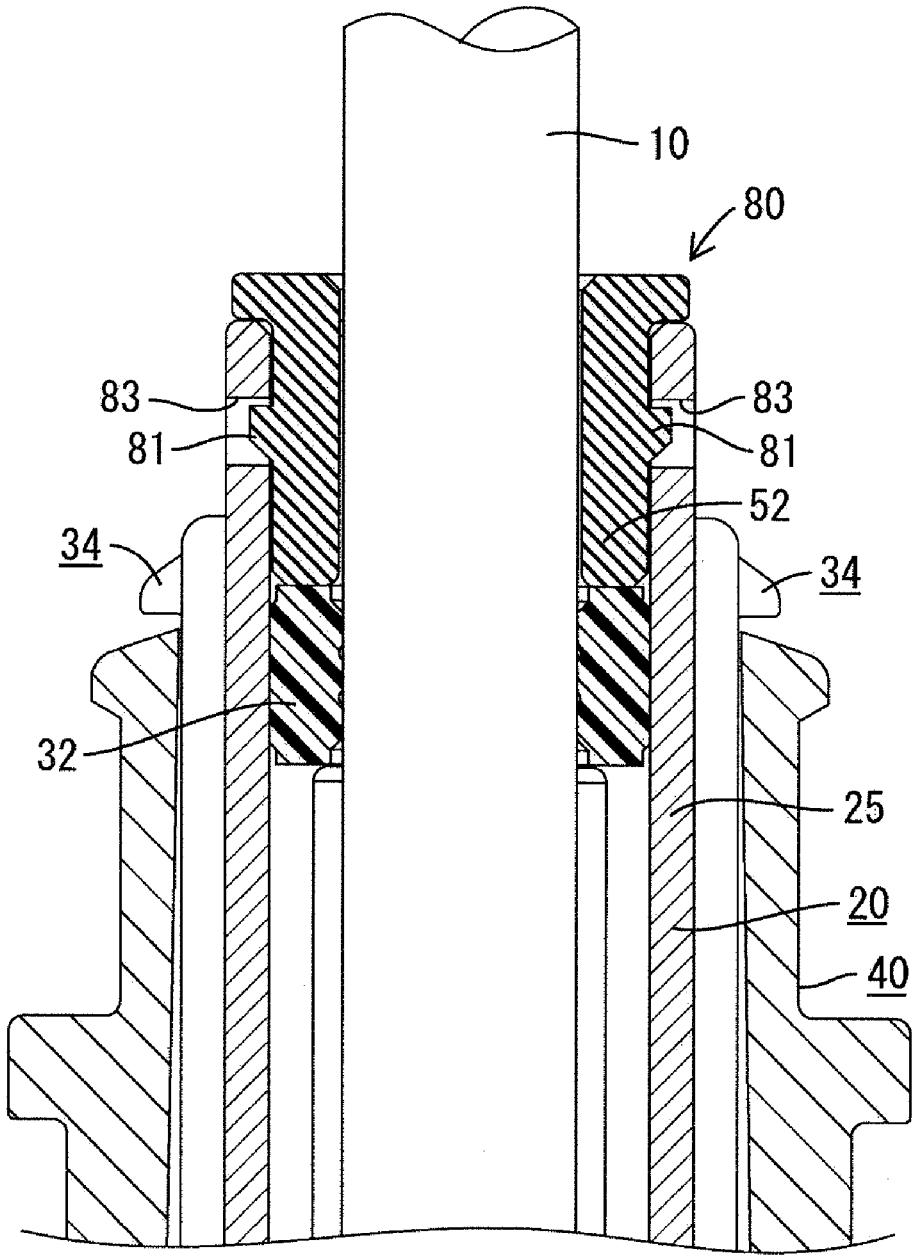
FIG. 27 is a partly sectional view showing a state in which the retainer of the second embodiment is mounted on the housing and is locked

As shown in FIG. 26, two front locking projections 81 and two rear locking projections 81 are formed on the peripheral surface of each hold-down part 52 of the retainer 80. Two front locking holes 83 and two rear locking holes 83 are formed on the peripheral surface of the housing 20 at the entrance 25A of each terminal accommodation part 25 thereof. The locking projections 81 fit in and lock to the corresponding locking hole 83.

The locking projection 81 of the retainer 80 is pressed into the terminal accommodation part 25 with the locking projections 81 expanding the entrance 25A of each terminal accommodation part 25. When the retainer 80 is pressed to a predetermined position, as shown in FIG. 27, the locking projection 81 fits in and is locked to the corresponding locking hole 83 to lock the retainer 80 on the housing 20.

The invention is not limited to the embodiments described above with reference to the drawings. For example, the following embodiments are also included in the technical scope of the invention.

The above-described retainer has two parts joined by the hinge. However, the retainer may be composed of two separate parts mounted on electric wires in advance.

In the above-described embodiments, the retainer also functions to hold down the rubber stopper. However the means for holding down the rubber stopper may be provided separately from the retainer.

The electric wire-side shielding connector is a female connector that accommodates female terminals in the above-described embodiments. However, the electric wire-side shielding connector may be a male connector with male terminals.

The invention is applicable to a non-waterproof shielding connector as well as the waterproof shielding connector exemplified in the above-described embodiments.

A bolt is used as a boost mechanism in the above-described embodiments to help the connectors fit favorably together. However, other types of boost mechanisms can be employed, such as a lever, or the boost mechanism can be omitted.

What is claimed is:

1. A shielding connector comprising:

a housing having opposite front and rear ends and terminal accommodating parts extending between the ends for accommodating a plurality of female terminals connected to electric wires so that the electric wires extend from the rear end of the housing;

a tubular shielding shell formed from metal and into which said housing is inserted so that said shielding shell extends substantially from the front end to the rear end of the housing;

an elastically flexible locking piece cantilevered rearward on said housing and having a rear end spaced outward from the terminal accommodating parts, a flexibility-allowing space defined between the locking piece and the terminal accommodating parts so that the locking piece is resiliently deflectable inwardly in an unlocking direction into the flexibility-allowing space, a hook at a rearward position on the locking piece and locking an open rear edge of said shielding shell for preventing removal of said housing when said housing is inserted properly into said shielding shell; and a retainer mounted on a rear end of said housing and having a portion projecting into the flexibility-allowing space for preventing said elastic locking piece from flexibly displacing in the unlocking direction into the flexibility allowing space, whereby the locking piece and the retainer prevent the shielding shell from separating from the housing in response to rearward pulling forces on the shielding shell.

2. The shielding connector of claim 1, wherein said terminal fittings are inserted into the terminal accommodation parts respectively formed in said housing, rubber stoppers closing rear entrances of each of said terminal accommodation parts, the retainer being disposed rearward of the rubber stoppers and being configured for holding said rubber stoppers in said terminal accommodation parts.

3. The shielding connector of claim 1, further comprising:

a braided wire surrounding a periphery of said electric wires, the braided wire having opposite first and second ends;

a braided wire-fixing part formed on said shielding shell, the first end of said braided wire being mounted on and covering said braided wire-fixing part; and a tightening band caulked inward over said the first end of said braided wire and fixed to said braided wire-fixing part.

4. A wire harness comprising the shielding connector of claim 3 and a shielding pipe mounted on a periphery of said electric wire at a position spaced from the housing, the second end of the braided wire being mounted on and covering a part of the shielding pipe, the tightening band being a first tightening band, the wire harness further having a second tightening band caulked inward over the second end of said braided wire and fixed to said shielding pipe, the first and second tightening bands having substantially equal thicknesses.

5. The wire harness of claim 4, further comprising a rubber boot mounted over the braided wire between the shielding shell and the shielding pipe; and third and fourth tightening bands caulked inward over opposite ends of the rubber boot and fixed respectively to the shielding shell and said shielding pipe, the third and fourth tightening bands having thicknesses substantially equal to the thicknesses of the first and second tightening bands.

6. The wire harness of claim 4, wherein the tightening bands each have a substantially U-shaped crimping portion accessible from an exterior portion of the wire harness.

7. A shielding connector comprising:

a tubular shielding shell formed from metal and having a rear open edge (48);

a housing having opposite front and rear ends and being inserted in the tubular shielding shell so that said shielding shell extends substantially from the front end to the rear end of the housing, an elastically flexible locking piece cantilevered rearward on said housing and being resiliently deflectable inwardly in an unlocking direction into a flexibility-allowing space on the housing, a hook at a rearward position on the locking piece and locking the rear open edge of said shielding shell for preventing rearward removal of said housing from the shielding shell; and a retainer mounted on the rear end of said housing and and having a portion projecting forward into the flexibility-allowing space for preventing said locking piece from flexibly displacing in the unlocking direction into the flexibility allowing space, whereby the locking piece and the retainer prevent the shielding shell from separating from the housing in response to rearward pulling forces on the shielding shell.

8. The shielding connector of claim 7, wherein the housing has terminal accommodation parts extending through the housing from the rear end to the front end, the shielding connector further comprising terminals connected to electric wires and accommodated in the respective terminal accommodation parts.

9. The shielding connector of claim 8, further comprising rubber stoppers mounted over the wires and disposed in the respective terminal accommodation parts, the retainer being disposed rearward of the rubber stoppers and being configured for holding said rubber stoppers in said terminal accommodation parts.

10. The shielding connector of claim 8, further comprising:

a braided wire surrounding a periphery of said electric wires, the braided wire having opposite first and second ends;

a braided wire-fixing part formed on said shielding shell, the first end of said braided wire being mounted on and covering said braided wire-fixing part; and a tightening band caulked inward over said the first end of said braided wire and fixed to said braided wire-fixing part.

11. The shielding connector of claim 8, wherein the retainer comprises first and second parts and a hinge joining the first and second parts.

* * * * *